US008383307B2

(12) United States Patent
Inoue et al.

(10) Patent No.: US 8,383,307 B2
(45) Date of Patent: Feb. 26, 2013

(54) TONER, DEVELOPER, AND IMAGE FORMING METHOD AND APPARATUS USING THE TONER

(75) Inventors: Ryota Inoue, Mishima (JP); Akihiro Kotsugai, Numazu (JP); Toyoshi Sawada, Hiratsuka (JP); Akiyoshi Sabu, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 533 days.

(21) Appl. No.: 12/575,804

(22) Filed: Oct. 8, 2009

(65) Prior Publication Data

US 2010/0104965 A1 Apr. 29, 2010

(30) Foreign Application Priority Data

Oct. 23, 2008 (JP) ..... 2008-273328

(51) Int. Cl.
*G03G 9/00* (2006.01)

(52) U.S. Cl. ..... 430/108.4; 430/119.1; 430/123.41; 430/137.1

(58) Field of Classification Search ..... 430/108.4, 430/119.1, 123.41, 137.1
See application file for complete search history.

(56) References Cited

U.S. PATENT DOCUMENTS

| | | | |
|---|---|---|---|
| 5,667,927 | A | 9/1997 | Kubota et al. |
| 6,432,600 | B2 | 8/2002 | Suwa et al. |
| 7,005,480 | B2 | 2/2006 | Kinsho et al. |
| 7,348,117 | B2 | 3/2008 | Inoue et al. |
| 2007/0015077 | A1* | 1/2007 | Yamashita et al. ..... 430/109.4 |
| 2007/0160782 | A1* | 7/2007 | Yatsuzuka et al. ..... 428/34.2 |
| 2008/0227002 | A1 | 9/2008 | Moriya et al. |
| 2008/0280218 | A1 | 11/2008 | Sabu et al. |
| 2009/0003885 | A1 | 1/2009 | Sabu et al. |

FOREIGN PATENT DOCUMENTS

| | | |
|---|---|---|
| JP | 59-96123 | 6/1984 |
| JP | 7-33861 | 2/1995 |
| JP | 7-120975 | 5/1995 |
| JP | 9-274335 | 10/1997 |
| JP | 9-319144 | 12/1997 |
| JP | 2001-166537 | 6/2001 |
| JP | 2002-284881 | 10/2002 |
| JP | 2008-171943 | 7/2008 |
| JP | 2009-58628 | 3/2009 |
| JP | 2009-75544 | 4/2009 |
| WO | WO 2010/001770 A1 | 1/2010 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

The toner includes a binder resin; a release agent; a colorant; and a dispersing resin configured to disperse the release agent. The dispersing resin includes a polyhydroxycarboxylic acid unit obtained from an optically active monomer. The polyhydroxycarboxylic acid unit has an optical purity of not greater than 80%, wherein the optical purity is defined as the absolute value of difference between the mole percentage of a L-monomer in the optically active monomer and the mole percentage of a D-monomer in the optically active monomer.

15 Claims, 2 Drawing Sheets

TONER, DEVELOPER, AND IMAGE FORMING METHOD AND APPARATUS USING THE TONER

BACKGROUND OF THE INVENTION

1. Field of the Invention

The present invention relates to a toner for use in developing an electrostatic image. In addition, the present invention also relates to a developer including the toner. Further, the present invention relates to an image forming method and an image forming apparatus, which form images using the toner.

2. Discussion of the Background

In conventional electrophotographic image forming apparatus and electrostatic recording apparatus, electrostatic latent images or magnetic latent images are visualized using toner. Specifically, electrophotographic image forming methods typically include the following processes:

(1) forming an electrostatic image on an image bearing member such as photoreceptors (electrostatic image forming process);

(2) developing the electrostatic image with toner to prepare a toner image on the image bearing member (developing process);

(3) transferring the toner image onto a receiving material such as paper sheets (transferring process); and (4) fixing the toner image on the receiving material upon application of heat or the like thereto, resulting in formation of a recorded image (fixing process).

The toner used for developing an electrostatic image is a particulate colored material in which a colorant, a charge controlling agent, etc., are included in a binder resin. The toner preparation method is broadly classified into pulverization methods and suspension polymerization methods.

The pulverization methods typically include the following processes:

(1) Dispersing a colorant, a charge controlling agent, an offset preventing agent, etc., in a thermoplastic resin by a melt blending method;

(2) Cooling the melted toner constituent mixture to solidify the mixture; and (3) Pulverizing the toner constituent mixture, followed by classifying, resulting in preparation of a mother toner (toner particles).

By using such pulverization methods, toner having reasonable properties can be obtained, but only limited materials can be used therefor (i.e., the flexibility of the methods in material selection is low). Specifically, the toner constituent mixture prepared by a melt blending method has to be pulverized and classified by a low-cost pulverizer and classifier. Namely, the toner constituent mixture has to be brittle enough to be pulverized. When pulverizing such a brittle toner constituent mixture, the resultant particles (i.e., the toner particles) have a relatively wide particle diameter distribution. In order to produce toner images having a good combination of resolution and half tone property using such toner particles, it is necessary to remove fine particles having a particle diameter of not greater than 5 μm and coarse particles having a particle diameter of not less than 20 μm from the toner particles, resulting in deterioration of yield of the toner. In addition, it is difficult for such pulverization methods to uniformly disperse a colorant, a charge controlling agent, etc., in a binder resin, and thereby a problem in that one or more of the properties (such as fluidity, developability, durability and image qualities) of the resultant toner deteriorate tends to be caused.

Further, the toner prepared by such pulverization methods is typically used for heat fixing methods in which a toner image on a receiving material is fused by a heat roller to be fixed thereon. In this case, when the temperature of the heat roller is too high, the toner is excessively melted, a hot offset phenomenon in that the melted toner is adhered to the heat roller is caused. In contrast, when the temperature of the heat roller is too low, the toner is not sufficiently melted, thereby causing a poor fixing problem in that the toner image is not sufficiently fixed.

Recently, a need exists for an energy saving image forming apparatus (such as copiers) having a small size. Therefore, the toner used for such an image forming apparatus preferably has a high hot offset temperature and a low fixable temperature (i.e., a good combination of hot offset resistance and low temperature fixability). In particular, in full color copiers and printers, the glossiness of fixed toner images and the color tones of fixed combined color toner images are important image qualities. Therefore, toner having a lower melting point is desired for such full color copiers and printers.

However, toner having a low melting point typically has not only a low hot offset temperature but also a poor preservability under high temperature and high humidity conditions. In order to prevent occurrence of the hot offset problem, a technique in that a release agent such as silicone oils is applied to a heat fixing roller to impart good releasability to the heat fixing roller is used for such full color image forming apparatus. In order to use such a technique, the image forming apparatus has to include an oil tank and an oil applicator, resulting in complexity and jumboization of the image forming apparatus. In addition, the heat roller tends to easily degrade due to the applied oil, and therefore the image forming apparatus requires periodical maintenance. Further, the image forming apparatus tends to cause a problem in that the oil applied to the heat fixing roller is adhered to a copy sheet, thereby causing a problem in that the color tone of the images is changed.

In order to prevent occurrence of the hot offset problem without applying an oil to a heat fixing roller, a technique in that a release agent such as waxes is included in the toner is typically used. In this regard, the releasability of the toner largely depends on the dispersion condition of the wax in the toner. Specifically, when the wax is dissolved in a binder resin, the toner cannot exert good releasability. When the wax is present as particles (domains) in a binder resin, the toner can exert good releasability. In this regard, when the particle diameter of the wax particles in a binder resin is too large, the amount of the wax present in the surface portion of the toner particles is relatively large. In this case, the toner particles tend to be agglomerated, and thereby the fluidity of the toner is deteriorated. In addition, a filming problem in that the wax is adhered to the carrier of the developer and the image bearing member such as photoreceptors, resulting in formation of a film of the toner thereon, thereby deteriorating the qualities of recorded images tends to be caused. In contrast, when the particle diameter of the wax particles in a binder resin is too small (i.e., the wax is excessively dispersed finely in a binder resin), the toner cannot exert good releasability.

It is difficult for the pulverization methods to control the particle diameter distribution of the wax dispersed in the toner particles. In addition, when the toner constituent mixture is pulverized, pulverization is typically caused at the wax domains. Therefore, the wax is typically present at the surface of the toner particles. Accordingly, the fluidity deterioration problem and the filming problem mentioned above tend to be caused.

In attempting to solve the problems, published unexamined Japanese patent applications Nos. (hereinafter referred to as JP-As) 09-319144 and 2002-284881 (corresponding to U.S.

Pat. No. 7,005,480) have disclosed resin solution suspension methods including the following processes:

(1) Dissolving a resin, which has been synthesized by a polymerization method, in a solvent to prepare a resin solution;

(2) Dispersing the resin solution in an aqueous medium in the presence of a dispersant such as surfactants and water-soluble resins, and a dispersion stabilizer such as particulate inorganic materials and particulate resins to prepare a dispersion; and (3) Removing the solvent from the dispersion by heating, depressurizing or the like method to prepare toner particles.

By using these methods, toner having a relatively sharp particle diameter distribution can be obtained without performing a classification operation.

In general, toner includes a binder resin in an amount of not less than 70% by weight, wherein the binder resin is obtained from oil resources. However, recently there are fears of deletion of oil resources and global warming due to discharge of a large amount of carbon dioxide caused by using a large amount of oil sources. In attempting to solve the problems, techniques in that resins obtained from plants, which grow by absorbing carbon dioxide, are used as binder resins have been proposed. In this case, carbon dioxide is circulated in the environment. Therefore, the techniques may prevent occurrence of the problems.

For example, JP-A 07-120975 proposes to use polylactic acid as a binder resin. However, polylactic acid exerts less thermoplastic action than polyester resins in the fixing process because of including ester bonds in a relatively high content. In addition, the toner constituent mixture has very high hardness, and thereby a problem in that the toner constituent mixture cannot be easily pulverized, resulting in deterioration of productivity tends to be caused.

JP-A 09-274335 proposes a toner including a colorant, and a polyester resin prepared by subjecting a composition including lactic acid and a tri- or more-functional oxycarboxylic acid to a dehydration polycondensation reaction. Since a polyester resin is prepared by subjecting the hydroxyl group of lactic acid and the carboxyl group of the oxycarboxylic acid to a dehydration polycondensation reaction in this proposal, the resultant polyester resin has a large molecular weight. Therefore, the resultant toner has poor sharp melting property, thereby deteriorating the low temperature fixability of the toner.

JP-A 2001-166537 discloses a toner including a polylactic acid based biodegradable resin and a terpene phenolic copolymer in attempting to improve the thermal properties of the toner. However, the toner cannot have a good combination of low temperature fixability and hot offset resistance.

Since these toners are prepared by pulverization methods, the toners have problems in that considerable losses are caused, and there are fears of environmental destruction due to disposal of the waste toner. In addition, the energy needed for such pulverization methods is relatively high. Therefore, it is necessary to reduce environmental burdens.

As JP-As 07-33861 and 59-96123 have disclosed, polylactic acid, which is a resin derived from plants and which is easily available, can be synthesized by subjecting lactic acid to dehydration condensation reaction or subjecting a cyclic lactide to a ring opening reaction. Therefore, the resin solution suspension methods mentioned above can be used for preparing a toner including polylactic acid. However, polylactic acid has a problem in that L-polylactic acid or D-polylactic acid itself has high crystallinity and has very poor solubility in organic solvents.

In addition, since polylactic acid has low crystallization speed, it is difficult to control the crystallization state of polylactic acid included in the toner prepared by a resin solution suspension method. In this regard, polylactic acid having an amorphous state has poor heat resistance, i.e., poor hot offset resistance. Further, there is a case where the toner prepared by a resin solution suspension method includes a mixture of polylactic acid having high crystallinity and polylactic acid having low crystallinity. When such a toner is agitated in a developing device, the toner particles tend to be broken at a portion consisting of polylactic acid having low crystallinity because such a portion has poor impact resistance. In this case, fine toner particles are formed, and thereby the charge amount of the toner is decreased with time, resulting in deterioration of image qualities (such as image density).

Because of these reasons, a need exists for a toner which has a good combination of fixability (low temperature fixability and hot offset resistance) and high temperature preservability and which can produce high quality images without causing the filming problem.

SUMMARY OF THE INVENTION

As an aspect of the present invention, a toner is provided. The toner includes a binder resin; a colorant; a release agent; and a dispersing resin configured to disperse the release agent. The dispersing resin includes a polyhydroxycarboxylic acid unit obtained from an optically active monomer. The polyhydroxycarboxylic acid unit has an optical purity X of not greater than 80%, wherein the optical purity X is defined by the following equation:

$$X(\%)=|X(L)-X(D)|,$$

wherein X(L) represents the mole percentage of a L-monomer in the optically active monomer, and X(D) represents the mole percentage of a D-monomer in the optically active monomer.

The toner is preferably prepared by a method including:

dissolving or dispersing at least the binder resin, colorant, release agent and dispersing resin in an organic solvent to prepare a toner constituent mixture liquid;

emulsifying or dispersing the toner constituent mixture liquid in an aqueous medium; and then removing the organic solvent from the emulsion or dispersion to prepare particles of the toner.

As another aspect of the present invention, a developer including the toner mentioned above and a carrier. The toner can be used as a one component developer.

As yet another aspect of the present invention, an image forming apparatus is provided. The image forming apparatus includes:

an image bearing member;

a charger configured to charge the image bearing member;

a light irradiating device configured to irradiate the charged image bearing member with light to form an electrostatic latent image on the image bearing member;

a developing device configured to develop the electrostatic latent image with a developer including the toner mentioned above to form a toner image on the image bearing member;

a transferring device configured to transfer the toner image onto a receiving material; and a fixing device configured to fix the toner image on the receiving material.

In this regard, the image bearing member and the developing device may be integrated as a process cartridge, which is detachably attachable to the image forming apparatus. The process cartridge includes at least the image bearing member and the developing device and can include other devices.

As a further aspect of the present invention, an image forming method is provided. The image forming method includes:

charging an image bearing member;

irradiating the charged image bearing member with light to form an electrostatic latent image on the image bearing member;

developing the electrostatic latent image with a developer including the toner mentioned above to form a toner image on the image bearing member;

transferring the toner image onto a receiving material; and fixing the toner image on the receiving material.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
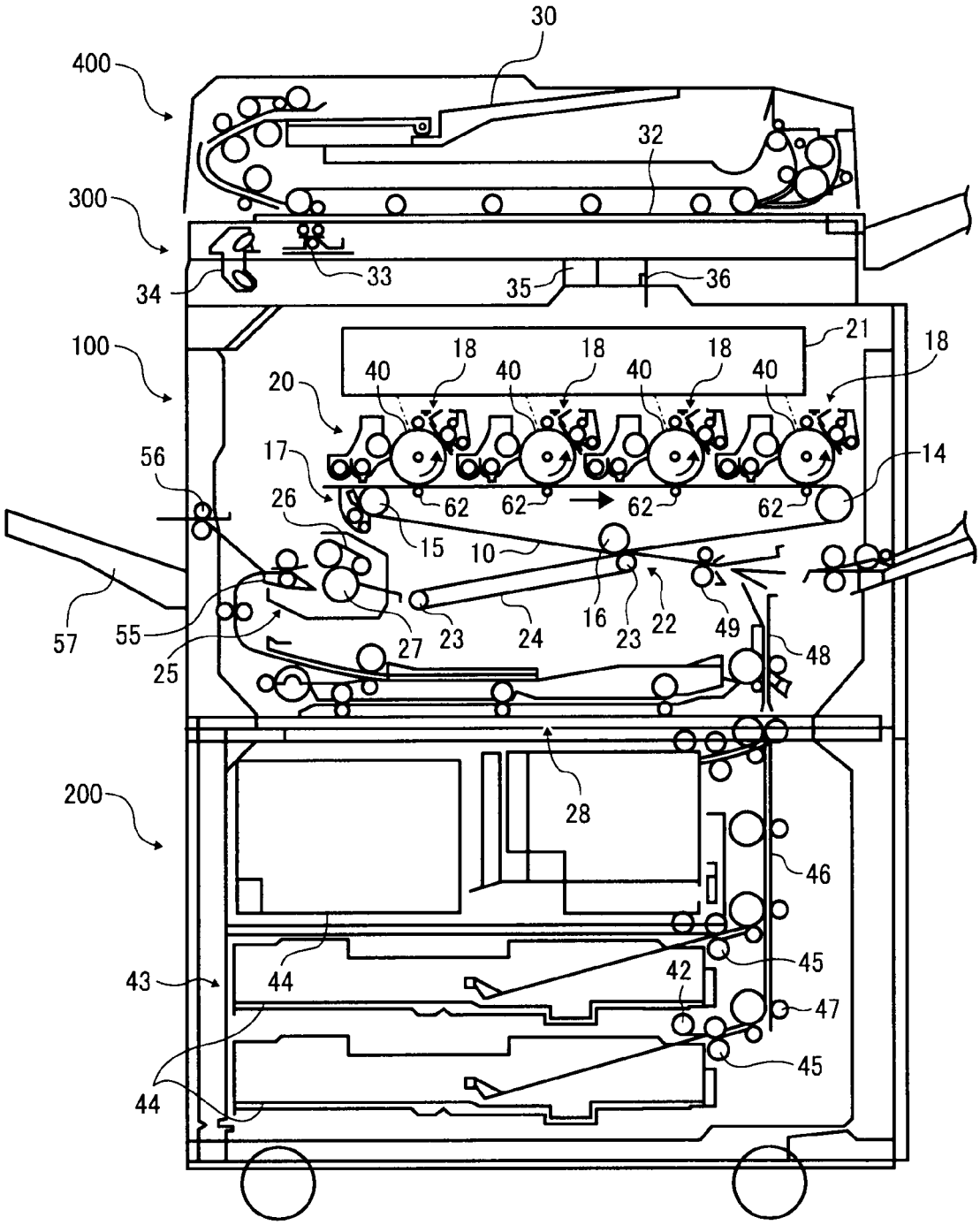
FIG. 1 is a schematic view illustrating an example of the image forming apparatus of the present invention.

At first, the toner of the present invention will be explained.

The toner of the present invention includes at least a binder resin, a colorant, a release agent and a dispersing resin configured to disperse the release agent, and optionally includes other components. The dispersing resin includes a polyhydroxycarboxylic acid unit obtained from an optically active monomer. The polyhydroxycarboxylic acid unit has an optical purity X of not greater than 80%, wherein the optical purity X is defined by the following equation:

$$X(\%)=|X(L)-X(D)|,$$

wherein X(L) represents the mole percentage of a L-monomer in the optically active monomer, and X(D) represents the mole percentage of a D-monomer in the optically active monomer.

The polyhydroxycarboxylic acid unit is preferably a unit obtained by polymerizing or copolymerizing an aliphatic hydroxycarboxylic acid having 3 to 6 carbon atoms. More preferably, the polyhydroxycarboxylic acid unit is a unit obtained by polymerizing or copolymerizing lactic acid or subjecting lactide to ring-opening polymerization. Even more preferably, the polyhydroxycarboxylic acid unit is a unit obtained by subjecting a mixture of L-lactide and D-lactide to ring-opening polymerization.

The dispersing resin preferably includes a linear polyester resin obtained by reacting a polyester diol having a polyhydroxycarboxylic acid unit with another polyester diol using a polymer chain growing agent.

The weight ratio (D/R) of the dispersing resin (D) to the release agent (R) is preferably from 100/100 to 10/100.

The binder resin preferably includes a polyester resin.

The binder resin preferably includes a reaction product of a compound having an active hydrogen-containing group with a polyester resin having a functional group capable of reacting with the active hydrogen-containing group. The functional group capable of reacting with the active hydrogen-containing group is preferably an isocyanate group.

The binder resin preferably has a glass transition temperature of from 40° C. to 70° C.

The toner preferably has a volume average particle diameter (Dv) of from 3 μm to 8 μm, and the ratio (Dv/Dn) of the volume average particle diameter (Dv) to the number average particle diameter (Dn) of the toner is preferably from 1.00 to 1.25.

The toner is preferably prepared by a method including:

dissolving or dispersing at least the binder resin, the colorant, the release agent and the dispersing resin in an organic solvent to prepare a toner constituent mixture liquid;

emulsifying or dispersing the toner constituent mixture liquid in an aqueous medium; and then removing the organic solvent from the emulsion or dispersion to prepare particles of the toner.

The toner of the present invention will be explained in detail.

At first, the dispersing resin will be explained.

The dispersing resin includes a polyhydroxycarboxylic acid unit (skeleton) obtained from an optically active monomer. The polyhydroxycarboxylic acid unit includes a unit obtained by polymerizing or copolymerizing a hydroxylcarboxylic acid. For example, methods in which a hydroxycarboxylic acid is directly subjected to a dehydration condensation reaction; and methods in which the corresponding cyclic ester is subjected to a ring-opening reaction can be used. Among these methods, the ring-opening reaction methods are preferably used because the molecular weight of the resultant polyhydroxycarboxylic acid can be heightened.

In order to impart a good combination of transparency and thermal properties to the toner, the optically active monomer used for forming the polyhydroxycarboxylic acid unit is preferably aliphatic polyhydroxycarboxylic acids, more preferably aliphatic polyhydroxycarboxylic acids having from 3 to 6 carbon atoms, and even more preferably lactic acid, and lactide. Circular hydroxycarboxylic acid esters can also be used as raw materials of the polyhydroxycarboxylic acid unit as well as hydroxycarboxylic acids. When a circular ester is used, the resultant polyhydroxycarboxylic acid unit is a unit obtained by polymerizing the hydroxycarboxylic acid constituting the circular ester. For example, the unit obtained from lactide is a unit obtained by polymerizing lactic acid.

In this regard, the optically active monomer satisfies the following relationship:

$$X(\%)=|X(L)-X(D)|\leqq 80\%,$$

wherein X represents the optical purity of the optically active monomer, X(L) represents the mole percentage of a L-monomer in the optically active monomer, and X(D) represents the mole percentage of a D-monomer in the optically active monomer.

The optical purity is not greater than 80%, and preferably not greater than 60%. When the optical purity falls in the range, the solubility in solvents and transparency of the resin can be enhanced.

In this regard, L-monomer and D-monomer are optical isomers, and chemical properties and physical properties thereof other than the optical properties are the same. Therefore, the reactivity thereof is the same, and the ratio of the monomers used is the same as the ratio of the units obtained by the monomers.

The dispersing resin can include a linear polyester resin (b1) obtained by reacting a polyester diol (b11) having a polyhydroxycarboxylic acid unit obtained from an optically active monomer with another polyester diol (b12) using a polymer chain growing agent.

In order to prepare such a linear polyester resin (b1), it is necessary that each of the polyester diol (b11), polyester diol (b12) and the polymer chain growing agent is di-functional. When one or more of them are tri- or more-functional, a crosslinking reaction is caused, and thereby a linear polyester cannot be obtained.

Linear polyesters have relatively high solubility compared to branched or crosslinked polyesters even when having a high molecular weight. Therefore, linear polyesters have viscoelasticity suitable for toner while having good productivity.

Since linear polyesters have simple structure, the molecular weight and the physical properties (such as thermal properties and compatibility with other resins) influenced by the molecular weight can be easily controlled. Linear polyesters for use in the toner of the present invention include a unit (b11) and another unit (b12), and have an advantage such that the factors of the unit (b12), such as species, molecular weight, and structure of the polyester diol used for the unit (b12), also influence the physical properties of the linear polyesters (b1), and therefore by controlling such factors, the physical properties of the linear polyesters (b1) can be controlled. Therefore, linear polyesters (b1) are superior to conventional compositions including lactic acid because of having much more physical property controlling factors.

The polyhydroxycarboxylic acid unit included in the polyester diol (b11) has a skeleton such that a hydroxycarboxylic acid is polymerized, and can be prepared by subjecting a hydroxycarboxylic acid to a direct dehydration condensation reaction or subjecting the corresponding ring-form ester to a ring-opening polymerization reaction. Among these methods, the ring-opening polymerization method is preferably used because the molecular weight of the resultant polyhydroxycarboxylic acid can be increased.

In view of the transparency and thermal properties of the toner, the optically active monomers for use in constituting the polyhydroxycarboxylic acid unit are preferably aliphatic hydroxycarboxylic acids, more preferably aliphatic hydroxycarboxylic acids having from 3 to 6 carbon atoms, and even more preferably lactic acid or lactide.

In addition to such hydroxycarboxylic acid monomers, cyclic hydroxylcarboxylic acid esters can also be used as raw materials for the polyhydroxycarboxylic acid unit. In this case, the resultant polyhydroxycarboxylic acid unit is a unit obtained by polymerizing the hydroxycarboxylic acid constituting the cyclic hydroxylcarboxylic acid ester. For example, the polyhydroxycarboxylic acid skeleton of a resin obtained by using lactide is the skeleton obtained by polymerizing lactic acid.

Even in this case, the optically active monomer satisfies the following relationship:

$$X(\%)=|X(L)-X(D)|\leqq 80\%,$$

wherein X represents the optical purity of the optically active monomer, X(L) represents the mole percentage of a L-monomer in the optically active monomer, and X(D) represents the mole percentage of a D-monomer in the optically active monomer.

The optical purity is not greater than 80%, and preferably not greater than 60%. When the optical purity falls in the range, the solubility in solvents and transparency of the resin can be enhanced.

In this regard, L-monomer and D-monomer are optical isomers, and chemical properties and physical properties thereof other than the optical properties are the same. Therefore, the reactivity thereof is the same, and the ratio of the monomers used is the same as the ratio of the units obtained by the monomers.

When preparing a polyester diol (b11) having a polyhydroxycarboxylic acid skeleton, polyhydric alcohols can be used to be copolymerized. Specific examples of such polyhydric alcohols include 1,2-propylene glycol, 1,3-propylene glycol, 1,4-butylene glycol, 1,6-hexanediol, adducts of bisphenols (e.g., bisphenol A, bisphenol F and bisphenol S) with an alkylene oxide such as ethylene oxides (E0), propylene oxides (PO) and butylenes oxides (BO) (the added amount of from 2 to 30 moles), and combinations of these compounds. Among these compounds, 1,2-propylene glycol, 1,3-propylene glycol, 1,4-butylene glycol, and alkylene oxide adducts of bisphenol A are preferably used, and 1,3-propylene glycol is more preferably used.

Suitable materials for use as the polyester diol (b12) include reaction products of a polyalcohol with a polycarboxylic acid (mentioned below for use as the binder resin). In this regard, it is preferable that the polyester diol (b12) includes an excess amount of hydroxyl groups by adjusting the ratio of a polyalcohol to a polycarboxylic acid. Specific examples of the polyester diol (b12) include reaction products of one or more of 1,2-propylene glycol, 1,3-propylene glycol, 1,4-butylene glycol, 1,6-hexanediol, adducts of bisphenols (e.g., bisphenol A, bisphenol F and bisphenol S) with an alkylene oxide such as ethylene oxides (EO), propylene oxides (PO) and butylenes oxides (BO) (the added amount of from 2 to 30 moles), and combinations of these compounds with one or more of terephthalic acid, isophthalic acid, adipic acid, succinic acid, and combinations of these compounds.

The polymer chain growing agent for use in subjecting the polyester diols (b11) and (b12) to a polymer chain growth reaction is not particularly limited as long as the agent includes two functional groups capable of reacting with the hydroxyl groups included in the polyester diols (b11) and (b12). Suitable materials for use as the polymer chain growing agent include difunctional compounds of polycarboxylic acids, polycarboxylic anhydrides, polyisocyanates, polyepoxides, etc. Among these compounds, diisocyanate compounds and dicarboxylic acids are preferably used and diisocyanate compounds are more preferably used because of having good compatibility with polyester diols (b11) and (b12).

Specific examples of the polymer chain growing agent include succinic acid, adipic acid, maleic acid (and maleic anhydride), fumaric acid (and fumaric anhydride), phthalic acid, isophthalic acid, terephthalic acid, 1,3- or 1,4-phenylene diisocyanate, 2,4- or 2,6-tolylene diisocyanate (TDI), 2,4'- or 4,4'-diphenylmethane diisocyanate (MDI), hexamethylene diisocyanate (HDI), dicyclohexylmethane-4,4'-diisocyanate (hydrogenated MDI), isophorone diisocyanate (IPDI), bisphenol A glycidyl ether, etc. Among these compounds, succinic acid, adipic acid, isophthalic acid, terephthalic acid, maleic acid (and maleic anhydride), fumaric acid (and fumaric anhydride), HDI and IPDI are preferably used, and maleic acid (and maleic anhydride), fumaric acid (and fumaric anhydride) and IPDI are more preferably used.

The added amount of the polymer chain growing agent is from 0.1 to 30% by weight, and preferably from 1 to 20% by weight based on the weight of the linear polyester (b1).

The content of a linear polyester resin included in the dispersing resin (b1) is determined in consideration of the properties and applications of the toner, but is preferably from 40 to 100% by weight, and more preferably from 60 to 90% by weight, based on the total weight of the dispersing resin in view of the transparency and thermal properties of the toner. Even when the hydroxylcarboxylic acid constituting the dispersing resin is an optically active monomer such as lactic acid, the content preferably falls in the above-mentioned range in view of solubility of the resin as long as the optical purity of the monomer is not greater than 80%. When the optical purity of the monomer is greater than 80%, the following relationship is preferably satisfied:

$$Y(\%)=-1.5X+220,$$

wherein Y represents the content of the linear polyester resin (b1) in the dispersing resin, and X represents the optical purity of the monomer.

The weight ratio (b11/b12) of the polyester diol (b11) to the polyester diol (b12) is preferably from 31/69 to 90/10, and more preferably from 40/60 to 80/20 in view of transparency and thermal properties of the toner.

If desired, other resins can be used as dispersing agents in combination with the linear polyester (b1) in consideration of the properties and applications of the toner. Specific examples of such resins include the resins mentioned above for use as the binder resin.

In general, vinyl resins, polyester resins, polyurethane resins, epoxy resins, and combinations of these resins can be used as the dispersing resin in combination with the linear polyester (b1). Among these resins, polyurethane resins and polyester resins are preferably used, and polyesters and polyurethanes, which include a unit obtained from 1,2-propylene glycol, are more preferably used.

The content of such a resin other than the linear polyester (1) in the dispersing resin is determined in consideration of the properties and applications of the toner, but is preferably from 0 to 60% by weight, and more preferably from 10 to 40% by weight, based on the total weight of the dispersing resin.

The binder resin is not particularly limited, and proper resins are selected from known resins in consideration of the application of the toner. Specific examples of the resins include polyester resins (such as modified polyester resins and unmodified polyester resins), polymers of styrene and styrene derivatives, styrene copolymers, methacrylic resins (e.g., polymethyl methacrylate, and polybutyl methacrylate), polyvinyl chloride, polyvinyl acetate, polyethylene, polypropylene, epoxy resins, epoxypolyol resins, polyol resins, phenolic resins, silicone resins, polyurethane, polyamide, furan resins, polyvinyl butyral, acrylic resins (e.g., polyacrylic acid resins), rosin, modified rosin, xylene resins, terpene resins, coumarone-indene resins, polycarbonate resins, aliphatic or alicyclic hydrocarbon resins, aromatic petroleum resins, etc. Among these resins, polyester resins (such as modified polyester resins and unmodified polyester resins) are preferably used because the resultant toner has good fixability. The molecular weight of the polyester resin and monomers used for forming the polyester resins are properly determined in consideration of the application of the toner.

Polyester resins for use as the binder resin of the toner of the present invention are prepared by subjecting a polyalcohol and a polycarboxylic acid to a dehydration condensation reaction.

Dihydric alcohols and polyhydric alcohols having three or more hydroxyl groups can be used as the polyalcohol. Specific examples of the dihydric polyalcohols include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, dihydric alcohols prepared by adding a cyclic ether such as ethylene oxide and propylene oxide to bisphenol A, etc. In addition, polyalcohols having three or more hydroxyl groups can be used in combination with dihydric alcohols to crosslink the polyester resins. Specific examples of the polyalcohols having three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxybenzene, etc.

Specific examples of the polycarboxylic acids include benzene dicarboxylic acids and their anhydrides (e.g., phthalic acid, isophthalic acid, and terephthalic acid); alkyldicarboxylic acids and their anhydrides (e.g., succinic acid, adipic acid, sebacic acid, and azelaic acid); unsaturated dibasic acids (e.g., maleic acid, citraconic acid, itaconic acid, alkenylsuccinic acid, fumaric acid, and mesaconic acid); anhydrides of unsaturated dibasic acids (e.g., maleic anhydride, citraconic anhydride, itaconic anhydride, and alkenylsuccinic anhydride); trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetrakis(methylenecarboxy)methane, 1,2,7,8-octanetetracarboxylic acid, trimers of embole, etc. Hydrides and partial alkyl esters of these carboxylic acids can also be used.

The binder resin can include a reaction product of a compound having an active hydrogen containing group and a polyester resin (hereinafter sometimes referred to as a polyester prepolymer) having a functional group capable of reacting with the active hydrogen containing group.

Suitable prepolymers include prepolymers having an isocyanate group. Such prepolymers can be prepared by reacting a polyester resin having an active hydrogen group with a polyisocyanate. When a polyester resin and a polyester prepolymer are used for the binder resin, the monomers used for preparing the polyester resin may be the same as or different from the monomers used for preparing the polyester prepolymer.

Specific examples of such an active hydrogen group include hydroxyl groups (alcoholic hydroxyl groups and phenolic hydroxyl groups), amino groups, carboxyl groups, mercapto groups, etc. Among these groups, alcoholic hydroxyl groups are preferable.

In order to impart a good combination of low temperature fixability and hot offset resistance to the toner, it is preferable that the polyester resin and the polyester prepolymer are partially compatible with each other. Namely, it is preferable that the polyester resin and the polyester prepolymer are similar in composition.

Specific examples of the polyisocyanate include aliphatic polyisocyanate (e.g., tetramethylene diisocyanate, hexamethylene diisocyanate, and 2,6-diisocyanatemethylcaproate); alicyclic polyisocyanate (e.g., isophorone diisocyanate, and cyclohexylmethane diisocyanate); aromatic diisocyanate (e.g., tolylene diisocyanate, diphenylmethane diisocyanate); aromatic aliphatic diisocyanate (e.g., $\alpha,\alpha,\alpha',\alpha'$-tetramethylxylylene diisocyanate); isocyanurate compounds; etc. These compounds are used alone or in combination.

In addition, blocked isocyanate compounds, which are blocked with phenol derivatives, oximes, caprolactams, or the like, can also be used as the polyisocyanate.

The equivalence ratio [NCO]/[OH] of the isocyanate group [NCO] of the polyisocyanate to the hydroxyl group [OH] of the polyester resin having a hydroxyl group is from 1 to 5, preferably from 1.2 to 4, and more preferably from 1.5 to 2.5. When the equivalence ratio is greater than 5, the low temperature fixability of the toner tends to deteriorate. When the equivalence ratio is less than 1, the content of the urea group included in the resultant modified polyester resin, which is obtained by subjecting the prepolymer to a crosslinking reaction and/or a polymer chain growth reaction, decreases, resulting in deterioration of the hot offset resistance.

The content of the unit obtained from a polyisocyanate in the polyester prepolymer is preferably from 0.5 to 30% by weight, more preferably from 1 to 30% by weight, and even more preferably from 2 to 20% by weight. When the content is less than 0.5% by weight, the hot offset resistance of the toner tends to deteriorate. When the content is greater than 30% by weight, the high temperature preservability and low temperature fixability tend to deteriorate.

The average number of isocyanate groups included in one molecule of the polyester prepolymer is preferably not less than 1, more preferably from 1.5 to 3, and even more preferably from 1.8 to 2.5. When the number of isocyanate groups is less than 1, the molecular weight of the crosslinked and/or extended modified polyester resin tends to decrease, resulting in deterioration of the hot offset resistance.

When preparing the toner of the present invention, it is preferable to subject a polyester prepolymer and a compound (hereinafter sometimes referred to as a crosslinking agent or polymer chain growing agent) having an active hydrogen group to a reaction (hereinafter sometimes referred to as a crosslinking reaction or polymer chain growth reaction) in an aqueous medium.

Suitable materials for use as the crosslinking agent or polymer chain growing agent include amines. Suitable amine compounds include diamines, tri- or more-amines, amino alcohols, aminomercaptans, amino acids, etc. Specific examples of the diamines include aromatic diamines (e.g., phenylene diamine, diethyltoluene diamine, and 4,4'-diaminodiphenyl methane); alicyclic diamines (e.g., 4,4'-diamino-3,3' dimethyldicyclohexylmethane, diaminocyclohexane, and isophorone diamine); aliphatic diamines (e.g., ethylene diamine, tetramethylene diamine, and hexamethylene diamine); etc. Specific examples of the tri- or more-amines include diethylene triamine, triethylene tetramine, etc. Specific examples of the amino alcohols include ethanol amine, hydroxyethyl aniline, etc. Specific examples of the amino mercaptan include aminoethyl mercaptan, aminopropyl mercaptan, etc. Specific examples of the amino acids include aminopropionic acid, aminocaproic acid, etc. In addition, blocked amines in which an amino group thereof is blocked, can also be used as amines. Specific examples thereof include ketimine compounds and oxazoline compounds, in which an amino group thereof is blocked with a ketone such as acetone, methyl ethyl ketone and methyl isobutyl ketone; etc. Among these amines, diamines and mixtures of a diamine with a small amount of a tri- or more-amine are preferably used.

The molecular weight of the modified polyesters can be controlled using a polymer chain growth inhibitor. Specific examples of the polymer chain growth inhibitor include monoamines (e.g., diethyl amine, dibutyl amine, butyl amine and lauryl amine), and blocked monoamines (e.g., ketimine compounds and oxazoline compounds) in which an amino group thereof is blocked with a ketone such as acetone, methyl ethyl ketone and methyl isobutyl ketone.

The equivalence ratio [NHx]/[NCO] of the amino group [NHx] of a an amine to the [NCO] group of a polyester prepolymer having an isocyanate group is from 1/3 to 3/1, preferably from 1/2 to 2/1, and more preferably from 2/3 to 1.5/1. When the ratio is less than ⅓ or greater than 3, the molecular weight of the resultant modified polyester decreases, resulting in deterioration of the hot offset resistance of the resultant toner.

The binder resin preferably has a glass transition temperature (Tg) of from 40 to 70° C., and more preferably from 45 to 65° C. When the glass transition temperature is lower than 40° C., the toner tends to degrade under high temperature conditions and in addition the hot offset problem tends to be caused. In contrast, when the glass transition temperature is higher than 70° C., the fixability of the toner tends to deteriorate.

The toner of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner. When the content of the colorant is less than 1% by weight, the toner tends to have a low tinting power. In contrast, when the content is greater than 15% by weight, the colorant cannot be well dispersed in the toner, resulting in deterioration of the tinting power and electric properties of the toner.

Master batches, which are complexes of a colorant with a resin, can be used as the colorant of the toner of the present invention.

Specific examples of the resins for use as the binder resin of the master batches include polyesters (such as the modified and unmodified polyester resins mentioned above), polymers of styrene or styrene derivatives such as polystyrene, poly-p-chlorostyrene, and polyvinyl toluene; copolymers of styrene with a vinyl monomer such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers; and other resins such as polymethyl methacrylate, polybutyl methacrylate, polyvinyl chloride, polyvinyl acetate, polyethylene, polypropylene, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, and paraffin waxes. These materials can be used alone or in combination.

Such master batches can be prepared by mixing one or more of the resins as mentioned above and one or more of the colorants as mentioned above, and kneading the mixture while applying a high shearing force thereto. In this case, an organic solvent can be added to increase the interaction between the colorant and the resin. In addition, a flushing method, in which an aqueous paste including a colorant and water is mixed with a resin dissolved in an organic solvent, and the mixture is then kneaded so that the colorant is transferred to the resin side (i.e., the oil phase), followed by removal of the organic solvent (and water, if desired), can be preferably used because the resultant wet cake can be used as it is without being dried. When performing the mixing and kneading process, dispersing devices capable of applying a high shearing force such as three roll mills can be preferably used.

The toner of the present invention includes a release agent. The release agent is not particularly limited, and proper materials are selected from known release agents in consideration of the application of the toner. For example, waxes are preferably used as the release agent.

Suitable waxes for use as the release agent include low molecular weight polyolefin waxes, synthesized hydrocarbon waxes, natural waxes, petroleum waxes, higher fatty acids and their metal salts, higher fatty acid amides, and modified versions of these waxes, etc. These waxes can be used alone or in combination.

Specific examples of the low molecular weight polyolefin waxes include polyethylene waxes, polypropylene waxes, etc. Specific examples of the synthesized hydrocarbon waxes include Fischer-Tropsch waxes. Specific examples of the natural waxes include bees waxes, carnauba waxes, candelilla waxes, rice waxes, montan waxes, etc. Specific examples of the petroleum waxes include paraffin waxes, microcrystalline waxes, etc. Specific examples of the higher fatty acids include stearic acid, palmitic acid, myristic acid, etc.

The release agent preferably has a melting point of from 40 to 160° C., more preferably from 50 to 120° C., and even more preferably from 60 to 90° C. When the melting point is lower than 40° C., the high temperature preservability of the toner tends to deteriorate. In contrast, when the melting point is higher than 160° C., the toner tends to cause a cold offset problem such that the offset phenomenon occurs at a relatively low fixing temperature, and thereby the receiving material sheet bearing a toner image thereon is adhered to the fixing member, resulting in occurrence of jamming of the receiving material sheet (i.e., the receiving material sheet is wound around the fixing member).

The weight ratio (D/R) of the dispersing resin (D) to the release agent (R) is preferably from 100/100 to 10/100, and more preferably from 100/100 to 20/100. When the content of the dispersing resin is too high, the highest fixable temperature decreases. In contrast, when the content of the dispersing resin is too low, the filming resistance of the toner deteriorates.

The content of the release agent in the toner is preferably not greater than 40% by weight, and more preferably from 3 to 30% by weight. When the content is greater than 40% by weight, the low temperature fixability of the toner deteriorates, and in addition, the glossiness of recorded images excessively increases (i.e., the image qualities deteriorate).

In addition to the above-mentioned essential toner components (i.e., binder resin, colorant, release agent and dispersing resin), the toner of the present invention can optionally include other components such as charge controlling agents, particulate inorganic materials, cleanability improving agents, magnetic materials, etc.

With respect to the charge controlling agent, known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The added amount of the charge controlling agent is preferably from 0.1 to 10 parts by weight, and more preferably from 0.2 to 5 parts by weight, per 100 parts by weight of the binder resin included in the toner. When the added amount is too small, the charge controlling effects cannot be well produced. When the added amount is too large, the toner is excessively charged. Thereby, the effect of the main charge controlling agent is deteriorated, and the electrostatic attraction between the toner and the developing roller seriously increases, resulting in deterioration of the fluidity of the toner, and formation of images with low image density.

The toner of the present invention can optionally include a particulate inorganic material as an external additive to improve the fluidity, developability, and chargeability of the toner.

Specific examples of the particulate inorganic materials include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc., but are not limited thereto. These materials can be used alone or in combination.

The particulate inorganic materials preferably have an average primary particle diameter of from 5 nm to 2 μm, and more preferably from 5 nm to 500 nm.

The added amount of the particulate inorganic materials is preferably from 0.01 to 5.0% by weight, and more preferably from 0.01 to 2.0% by weight, based on the weight of the toner.

The surface of the particulate inorganic materials is preferably subjected to a treatment using a fluidity improving agent (i.e., hydrophobizing agent) to improve fluidity of the toner under high humidity conditions and to prevent deterioration of the charging properties of the toner. Specific examples of the hydrophobizing agents include silane coupling agents, silylating agents, silane coupling agents having a fluorinated alkyl group, organic titanate coupling agents, aluminum coupling agents, silicone oils, modified silicone oils, etc. Particularly, silica and titanium oxide, which are subjected to a hydrophobizing treatment using such a hydrophobizing agent, are preferably used for the toner of the present invention.

The toner of the present invention can optionally include a cleanability improving agent so that the toner remaining on the image bearing member (such as photoreceptors and intermediate transfer mediums) even after an image transfer process can be well removed by a cleaner. Specific examples of the cleanability improving agent include fatty acid metal salts (e.g., zinc stearate, and calcium stearate); particulate polymers (e.g., particulate polystyrene prepared by a soap-free emulsion polymerization method. The particulate polymers preferably have a narrow particle diameter distribution, and a volume average particle diameter of from 0.01 to 1 μm.

The toner of the present invention can optionally include a magnetic material. Specific examples thereof include iron powders, magnetite powders, ferrite powders, etc. In order that the color tone of the toner is not affected by the magnetic material, magnetic materials having white color are preferably used.

The toner of the present invention preferably has a volume average particle diameter (Dv) of from 3.0 to 8.0 μm. In addition, the toner of the present invention preferably has a ratio (Dv/Dn) of the volume average particle diameter (Dv) to the number average particle diameter (Dn) of from 1.00 to 1.25. In this case, the toner can have a good combination of high temperature preservability, low temperature fixability and hot offset resistance. Particularly, when such a toner is used for full color copiers, the toner can produce glossy images. In addition, when the toner is used for a two component developer, variation of the particle diameter distribution of the toner is little and the toner can maintain good developability even when the toner is agitated over a long period of time in a developing device while a fresh toner is supplied thereto. Conventional toners tend to have a drawback in that toner particles having a relatively large particle diameter are mainly used for developing electrostatic latent images, and the content of fine toner particles increases after long repeated use, resulting in change of image qualities.

Further, when the toner of the present invention is used as a one component developer, the variation of the particle diameter distribution of the toner is little even after long repeated use of the toner while a fresh toner is supplied thereto. In addition, occurrence of the problems in that the toner is adhered to a developing roller, resulting in formation of a toner film, and the toner is fixedly adhered to a blade configured to form a thin developer layer on the developing roller can be prevented. As a result, high quality images can be stably produced even when the toner is used over a long period of time in the developing device while agitated.

In general, higher quality and higher definition images can be obtained by using a toner with a smaller particle diameter. However, toner with a smaller particle diameter is generally inferior in transferability and cleanability. When toner constituted of toner particles having a volume average particle diameter of less than 3 μm is used for a two component developer and the developer is agitated in a developing device, the toner tends to be fixedly adhered to the surface of the carrier after long repeated use, thereby deteriorating the charging ability of the carrier. When such a small toner is used as a one component developer, problems in that the toner is adhered to a developing roller, resulting in formation of a toner film, and the toner is fixedly adhered to a blade configured to form a thin developer layer on the developing roller tend to occur.

In contrast, when the toner has a volume average particle diameter of greater than 8 μm or the ratio (Dv/Dn) is greater than 1.25, high quality and high definition images cannot be produced, and in addition a problem in that the particle diameter of the toner largely varies when the toner is used over a long period of time while a fresh toner is supplied is caused.

The volume average particle diameter (Dv) and number average particle diameter (Dn) of the toner are measured with a particle diameter measuring instrument such as MULTISIZER III from Beckman Coulter Inc. using an aperture of 100 μm and analysis software BECKMAN COULTER MULTISIZER 3 VERSION 3.51. Specifically, the procedure is as follows.

(1) 0.5 g of a sample (toner) and 0.5 ml of a 10 wt % aqueous solution of an alkylbenzenesulfonate (NEOGEN SC-A from Dai-ichi Kogyo Seiyaku Co., ltd. are mixed in a 100 ml glass beaker;

(2) After the mixture is mixed with a micro spatula, 80 ml of ion-exchange water is added thereto;

(3) The mixture was subjected to a dispersing treatment for 10 minutes using an ultrasonic dispersing machine W-113MK-11 from Honda Electronics Co., Ltd.; and (4) The particle diameters Dv and Dn of the dispersion are measured with the instrument (MULTISIZER III) and a medium, ISOTON III from Beckman Coulter Inc., wherein the dispersion is dropped into ISOTON III so that the concentration indicated by the instrument falls in a range of 8±2%.

The method for preparing the toner of the present invention is not particularly limited. For example, the following methods can be used:

(1) Pulverization methods in which toner constituents are melted and kneaded, the kneaded toner constituent mixture is pulverized, followed by classification to prepare toner particles;

(2) Polymerization methods (suspension polymerization methods and emulsion polymerization methods) in which a monomer composition including a crystalline polymer and a polymerizable monomer is directly polymerized in an aqueous medium;

(3) Addition polymerization methods in which a composition including a crystalline polymer and a prepolymer having an isocyanate group is reacted with a crosslinking agent (and/or a polymer chain growing agent) such as amines in an aqueous medium to crosslink and/or extend the prepolymer while forming toner particles in the aqueous medium;

(4) Methods in which toner constituents are dissolved in a solvent, the solvent is removed therefrom, and then the mixed and dried toner constituent mixture is pulverized to prepare toner particles; and (5) Melted toner spraying methods in which a melted toner constituent mixture is sprayed in the air to prepare toner particles.

Specifically, in the pulverization methods, toner constituents including at least a binder resin, a colorant, a release agent, and a dispersing resin, and optionally including other constituents such as charge controlling agents are mixed. The toner constituent mixture is melted and kneaded upon application of heat thereto. After the kneaded toner constituent mixture is cooled, the kneaded mixture is pulverized. After the pulverizing process or at the same time as the pulverizing process, the pulverized toner constituent mixture is classified to prepare a mother toner (i.e., toner particles without external additives). In order to increase the average circularity of the resultant toner particles, the toner particles may be subjected to a shape controlling treatment in which a mechanical impact is applied to the toner particles using a machine such as HYBRIDIZER or MECHANO FUSION SYSTEM (manufactured by Hosokawa Micron Corp.).

A kneader is used for melting and kneading the toner constituent mixture. Suitable kneaders for use in the melt-kneading process include batch kneaders such as roll mills; continuous double-axis kneaders such as KTK double-axis extruders from Kobe Steel, Ltd., TEM double-axis extruders from Toshiba Machine Co., Ltd., double-axis extruders from KCK Co., PCM double-axis extruders from Ikegai Corp., and KEX double-axis extruders from Kurimoto, Ltd.; continuous single-axis kneaders such as KO-KNEADER from Buss AG; etc.

The melt-kneading process is preferably performed under proper conditions such that the molecular chains of the binder resin are not cut in the kneading process. Specifically, the melting/kneading temperature is determined depending on the softening point of the binder resin. When the kneading temperature is too high compared to the softening point, the molecular chains of the binder resin tend to be cut. In contrast, when the kneading temperature is too low compared to the softening point, the toner constituents cannot be well dispersed.

In the pulverization process, the kneaded toner constituent mixture is pulverized. It is preferable that at first the kneaded toner constituent mixture is roughly pulverized, and then finely pulverized. In this pulverization process, methods in which particles of the toner constituent mixture are collided to a collision plate using jet air to be pulverized; methods in which particles of the toner constituent mixture are collided to each other using jet air to be pulverized; and methods in which particles of the toner constituent mixture are fed into a narrow gap formed by a rotor and a stator to be mechanically pulverized, can be preferably used.

In the classification process, the pulverized toner constituent mixture is classified to prepare particles having a predetermined particle diameter. In the classification process, for example, fine particles are removed using a device such as cyclones, decanters, and centrifugal separators. In addition, the pulverized toner constituent mixture is classified in an air stream using a centrifugal force.

The suspension polymerization methods typically include the following processes:

(1) A colorant, a release agent and a dispersing resin are dispersed in a polymerizable monomer including an oil soluble polymerization initiator to prepare an oil phase liquid;

(2) The oil phase liquid is emulsified (dispersed) in an aqueous medium including a surfactant and a solid dispersant;

(3) The emulsion is subjected to a polymerization reaction to prepare particles (mother toner particles); and (4) A particulate inorganic material is adhered to the toner particles in the aqueous medium.

The particles are preferably washed with water before the process (4) to remove the excessive surfactant therefrom, and then the resultant toner particles are optionally subjected to a treatment.

It is preferable that the polymerizable monomer includes acids such as acrylic acid, methacrylic acid, α-cyanoacrylic acid, α-cyanomethacrylic acid, itaconic acid, crotonic acid, fumaric acid, maleic acid and maleic anhydride; amino-containing (meth)acrylate such as acrylamide, methacrylamide, diacetone acrylamide, and methylol compounds of these compounds, vinylpyridine, vinylpyrrolidone, vinylimidazole, ethyleneimine, and dimethylaminoethyl methacrylate; etc. In this case, a functional group can be attached to the surface of the resultant toner particles. In addition, by using a dispersant having an acid group or a basic group, it becomes possible to attach the group to the surface of the resultant toner particles.

The emulsion polymerization methods typically include the following processes:

(1) A water-soluble polymerization initiator and a polymerizable monomer are emulsified in water using a surfactant;

(2) The emulsion is polymerized using an emulsion polymerization method to prepare a latex;

(3) On the other hand, a colorant, a release agent and a dispersing resin are dispersed in an aqueous medium to prepare a dispersion;

(4) the dispersion is mixed with the latex and then the mixture is agglomerated to prepare particles having a desired toner particle size;

(5) The agglomerated particles are heated so as to be fused, resulting in formation of toner particles; and (6) A particulate inorganic material is adhered to the toner particles in the aqueous medium.

By using such a monomer as mentioned above for use in the suspension polymerization methods, a functional group can be attached to the surface of the toner particles.

Among these methods, the method including the following processes can be preferably used:

(i) Toner constituents including at least a binder resin, a colorant, a release agent, and a dispersing resin are dissolved or dispersed in an organic solvent to prepare a toner constituent mixture liquid;

(ii) The toner constituent mixture liquid is emulsified or dispersed in an aqueous medium to prepare an emulsion (dispersion); and (iii) The solvent is removed therefrom to prepare a dispersion of toner particles.

This method has the following advantages:

(1) The resin selection flexibility is high;

(2) The resultant toner has good low temperature fixability; and (3) The toner particles can be easily prepared while the particle size, particle diameter distribution and shape of the toner particles can be easily controlled.

In addition, the binder resin preferably include a polyester resin (polyester prepolymer) having a functional group (such as isocyanate groups) capable of reacting with an active hydrogen group. In this case, the polyester prepolymer is reacted with a compound having an active hydrogen group in the emulsion, followed by removal of the solvent, resulting in formation of particles in the aqueous medium. Specifically, the toner preparation method includes the following processes (1) to (6).

(1) Preparation of Toner Constituent Mixture Liquid (i.e., Oil Phase Liquid)

At first, toner constituents are dissolved or dispersed in an organic solvent to prepare a toner constituent mixture liquid.

Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ester solvents are preferably used and ethyl acetate is more preferably used because of being capable of dissolving polyester resins.

The weight ratio (S/T) of the organic solvent (S) to the toner constituents (T) is not particularly limited, but is generally from 40/100 to 300/100, preferably from 60/100 to 140/100 and more preferably from 80/100 to 120/100.

(2) Preparation of Aqueous Phase Liquid

The aqueous phase liquid is prepared, for example, by dispersing a particulate resin in an aqueous medium. The content of a particulate resin in the aqueous medium is not particularly limited, but is generally from 0.5 to 10% by weight.

Suitable solvent for use as the aqueous medium include water and water-compatible solvents. These solvents can be used alone or in combination. Specific examples of such water-compatible solvents include alcohols such as methanol, isopropanol, and ethylene glycol; dimethylformamide, tetrahydrofuran, cellosolves such as methyl cellosolve, lower ketones such as acetone and methyl ethyl ketone, etc. Among these solvents, water is preferably used.

Suitable resins for use as the particulate resin include known resins which can form an aqueous dispersion.

Specific examples thereof include thermoplastic and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins and polyester resins are preferably used because an aqueous dispersion including fine spherical resin particles can be easily prepared. Specific examples of the vinyl resins include homopolymers or copolymers obtained from one or more vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

Alternatively, the particulate resin may be copolymers including a unit obtained from a monomer having two or more unsaturated groups. Specific examples of such monomers include sodium salts of sulfate of ethylene oxide adducts of methacrylic acid, divinyl benzene, 1,6-hexanedioldiacrylate, etc.

The particulate resin can be prepared by known polymerization methods. However, it is preferable to prepare an aqueous dispersion including a particulate resin. Specific examples of the method for preparing such an aqueous resin dispersion are as follows.

(a) A method in which one or more vinyl monomers are polymerized using a method such as suspension polymerization methods, emulsion polymerization methods, seed polymerization methods and dispersion polymerization to directly prepare an aqueous dispersion of a vinyl resin;

(b) A method in which a precursor (monomer or oligomer) of a polyaddition type resin or a polycondensation type resin such as polyester resins, polyurethane resins and epoxy resins or a solution of the precursor is dispersed in an aqueous medium in the presence of a proper dispersant, and the dispersion is heated so that the precursor is polymerized and optionally crosslinked (using a crosslinking agent), resulting in preparation of an aqueous dispersion of the resin;

(c) A method in which a precursor (monomer or oligomer) of a polyaddition type resin or a polycondensation type resin such as polyester resins, polyurethane resins and epoxy resins or a solution of the precursor (or a melted precursor) is mixed with an emulsifier and then water is added thereto to perform phase inversion, followed by polymerization, resulting in preparation of an aqueous dispersion of the resin;

(d) A method in which a resin prepared by a polymerization method such as addition polymerization, ring-opening polymerization, polyaddition reaction, addition condensation and polycondensation polymerization is pulverized with a pulverizer such as mechanical rotation pulverizers and jet air pulverizers, followed by classification, to prepare a particulate resin, and the particulate resin is dispersed in water using a proper dispersant to prepare an aqueous dispersion of the particulate resin;

(e) A method in which a resin prepared by a polymerization method such as addition polymerization, ring-opening polymerization, polyaddition reaction, addition condensation and polycondensation polymerization is dissolved in a solvent, followed by spraying of the solution to prepare a particulate resin, and the particulate resin is dispersed in water using a proper dispersant to prepare an aqueous dispersion of the particulate resin;

(f) A method in which a resin prepared by a polymerization method such as addition polymerization, ring-opening polymerization, polyaddition reaction, addition condensation and polycondensation polymerization is dissolved in a solvent to prepare a resin solution; the resin solution is mixed with a solvent which cannot dissolve the resin, or the solution is cooled, to precipitate particles of the resin therein; the solvent is separated from the particulate resin; and then the particulate resin is dispersed in water using a proper dispersant to prepare an aqueous dispersion of the resin;

(g) A method in which a resin prepared by a polymerization method such as addition polymerization, ring-opening polymerization, polyaddition reaction, addition condensation and polycondensation polymerization is dissolved in a solvent, and the solution is dispersed in an aqueous medium using a proper dispersant, followed by removal of the solvent, to prepare an aqueous dispersion of the resin; and (h) A method in which a resin prepared by a polymerization method such as addition polymerization, ring-opening polymerization, polyaddition reaction, addition condensation and polycondensation polymerization is dissolved in a solvent, the solution is mixed with an emulsifier, and then water is added thereto to perform phase inversion, followed by removal of the solvent, to prepare an aqueous dispersion of the resin.

In order to stabilize the drops of the toner constituent mixture liquid and to prepare particles having a desired particle form and a sharp particle diameter distribution in the emulsification or dispersion process, the aqueous medium preferably includes a dispersant. Suitable materials for use as the dispersant include surfactants, inorganic dispersants which are hardly soluble in water, polymer protection colloids, etc. These dispersants can be used alone or in combination. Among these dispersants, surfactants are preferably used.

Suitable surfactants for use as dispersants include anionic surfactants, cationic surfactants, nonionic surfactants, and ampholytic surfactants.

Suitable anionic surfactants include alkylbenzene sulfonic acid salts, α-olefin sulfonic acid salts, and phosphoric acid salts. It is preferable to use fluorine-containing surfactants.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of anionic surfactants having a fluoroalkyl group include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Suitable cationic surfactants include amine salt based surfactants and quaternary ammonium salt based surfactants. Specific examples of the amine salt based surfactants include alkyl amine salts, aminoalcohol fatty acid derivatives, polyamine fatty acid derivatives and imidazoline.

Specific examples of the quaternary ammonium salt based surfactants include alkyltrimethyl ammonium salts, dialkyldimethyl ammonium salts, alkyldimethyl benzyl ammonium salts, pyridinium salts, alkyl isoquinolinium salts and benzethonium chloride. It is preferable to use fluorine-containing cationic surfactants.

Specific examples of the cationic surfactants having a fluoroalkyl group include primary, secondary and tertiary aliphatic amino acids having a fluoroalkyl group, perfluoroalkyl (C6-C10)sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Suitable nonionic surfactants include fatty acid amide derivatives, and polyhydric alcohol derivatives.

Suitable ampholytic surfactants include alanine, dodecyldi (aminoethyl)glycin, di(octylaminoethyle)glycin, and N-alkyl-N,N-dimethylammonium betaine.

Suitable inorganic dispersants hardly soluble in water include tricalcium phosphate, calcium carbonate, titanium oxide, colloidal silica, hydroxyapatite, etc.

Suitable polymer protection colloids include homopolymers and copolymers of acid monomers, (meth)acrylic monomers having a hydroxyl group, vinyl alcohol and ethers of vinyl alcohol, esters of vinyl alcohol and compounds having a carboxyl group, amides and methylol compounds thereof, acid chlorides, and monomers having a nitrogen atom or a heterocyclic ring including a nitrogen atom; polyoxyethylene resins; and cellulose compounds.

Specific examples of the acid monomers include acrylic acid, methacrylic acid, α-cyanoacrylic acid, α-cyanomethacrylic acid, itaconic acid, crotonic acid, fumaric acid, maleic acid and maleic anhydride.

Specific examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide.

Specific examples of the ethers of vinyl alcohol include vinyl methyl ether, vinyl ethyl ether and vinyl propyl ether.

Specific examples of the esters of vinyl alcohol with a compound having a carboxyl group include vinyl acetate, vinyl propionate and vinyl butyrate.

Specific examples of the acrylic amides include acrylamide, methacrylamide, and diacetoneacrylamide.

Specific examples of the acid chlorides include acrylic acid chloride and methacrylic acid chloride.

Specific examples of the monomers having a nitrogen atom or a heterocyclic ring having a nitrogen atom include vinyl pyridine, vinyl pyrrolidone, vinyl imidazole and ethylene imine.

Specific examples of the polyoxyethylene resins include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the cellulose compounds include methyl cellulose, hydroxyethyl cellulose and hydroxypropyl cellulose.

In the process of preparing a dispersion of a particulate resin, a dispersion stabilizer can be used if desired. Specific examples of the dispersion stabilizers include compounds which are soluble in acids and alkalis, such as calcium phosphate.

In a case where the binder resin includes a polyester prepolymer, the aqueous medium preferably includes a catalyst for use in urea reactions and urethane reactions. Specific examples of the catalyst include dibutyltin laurate and dioctyltin laurate.

(3) Preparation of Emulsion

An emulsion is prepared by emulsifying or dispersing the toner constituent mixture liquid in the aqueous medium. In this case, it is preferable to agitate the mixture.

Suitable devices for use in the emulsifying/dispersing process include batch emulsifiers such as homogenizers (from IKA WORKS), POLYTRON (from KINEMATICA AG), and TK AUTO HOMOMIXER (from Tokushu Kika Kogyo Co., Ltd.); continuous emulsifies such as EBARA MILDER (from Ebara Corporation), TK FILMIX and TK PIPELINE HOMOMIXER (from Tokushu Kika Kogyo Co., Ltd.), colloid mills (from Shinko Pantech), SLUSHER and TRIGONAL wet pulverizers (from Mitsui Miike Machinery Co., Ltd.), CAVITRON (from EUROTEC, LTD), and FINE FLOW MILL (from Pacific Machinery & Engineering Co., Ltd.); high pressure emulsifiers such as MICRO FLUIDIZER (from Mizuho Industrial Co., Ltd.), and NANOMIZER (from NANOMIZER INC.), APV GAULIN (from Gaulin Corp.); layer emulsifiers such as layer emulsifiers (from REICA Kogyo Co., Ltd.); vibration mixers such as VIBROMIXER (from REICA Kogyo Co., Ltd.); ultrasonic emulsifiers such as ultrasonic homogenizers Branson (from Emerson Japan Ltd.); etc.

Among these emulsifiers, APV GAULIN, homogenizers, TK AUTO HOMOMIXER, EBARA MILDER, TK FILMIX, and TK PIPELINE HOMOMIXER are preferably used.

(4) Removal of Organic Solvent

In order to remove the organic solvent from the thus prepared emulsion, a method in which the emulsion is gradually heated to perfectly evaporate the organic solvent included in the drops of the oil phase liquid can be used. Alternatively, a method in which the emulsion is sprayed in a dry environment to evaporate the organic solvent in the drops of the oil phase liquid and water in the dispersion, resulting in formation of toner particles, can be used.

(5) Washing, Drying and Classifying

When the organic solvent is removed, mother toner particles are formed. The thus prepared mother toner particles are washed and dried. When the thus prepared toner particles have a wide particle diameter distribution even after the particles are subjected to a washing treatment and a drying treatment, the toner particles are preferably subjected to a classification treatment using a cyclone, a decanter or a classifier utilizing centrifuge to remove fine particles therefrom. In this case, it is preferable to perform the classification operation in the liquid including the particles in view of efficiency. Alternatively, the dried mother toner particles may be classified.

In this regard, when a dispersion stabilizer soluble in an acid or alkali (such as calcium phosphate) is used, it is preferable to remove the dispersion stabilizer from the toner particles by washing the toner particles with an acid to dissolve the dispersion stabilizer, followed by washing with water.

(6) Addition of External Additive

The thus prepared mother toner particles can be mixed with one or more other particulate materials such as particulate inorganic materials (e.g., silica and titanium oxide) while optionally applying mechanical impact thereto to fix the particulate materials on the toner particles.

Suitable mechanical impact application methods include methods in which a mixture is mixed with a highly rotated blade and methods in which a mixture is put into jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The color of the toner is not particularly limited. However, it is preferable that the toner is one of black, cyan, magenta and yellow toners. For example, by using one or more proper colorants selected from the colorants mentioned above, such color toners can be prepared.

The toner of the present invention has good properties such as fluidity and fixability, and has a good combination of low temperature fixability and high temperature preservability. Therefore, the toner of the present invention can be preferably used for various fields, especially, for electrophotographic image formation fields.

The developer for use in developing an electrostatic latent image on an image bearing member includes at least the toner mentioned above, and further includes a carrier and other components, if necessary. The developer may be a one component developer or a two component developer. However, two component developers are preferably used for high speed printers, which can process at an increased information processing speed so as to be used for recent high speed image formation, two component developers are preferably used because of having a long life.

When the toner of the present invention is used for a two component developer, the developer has the following advantages.

(1) Even when the developer is used for a long time while the toner is replenished thereto, the particle diameter distribution of the toner hardly changes and occurrence of problems in that a toner film is formed on the developing roller and the toner is adhered to the developer thickness controlling blade for forming a developer layer on the developing roller can be prevented. Thereby, the development operation can be stably performed, resulting in formation of high quality images.

(2) Even when the developer is agitated in the developing device while the toner is replenished thereto, the particle diameter distribution of the toner in the developer hardly changes, and thereby the development operation can be stably performed, resulting in formation of high quality images.

The carrier for use in the two component developer is not particularly limited, and one or more proper carriers are chosen while considering the usage of the developer. However, it is preferable to use a carrier in which a core material is coated with a resin.

Suitable materials for use as the core material include manganese-strontium materials and manganese-magnesium materials, which have a saturation magnetization of from 50 to 90 $Am^2/kg$ (i.e., 50 to 90 emu/g). In view of image density, iron powders (having a saturation magnetization not less than 100 $Am^2/kg$ (100 emu/g) and magnetite having a saturation magnetization of from 75 to 120 $Am^2/kg$ (75 to 120 emu/g) are preferably used. In addition, copper-zinc materials having a saturation magnetization of from 30 to 80 $Am^2/kg$ (30 to 80 emu/g) can be preferably used because the impact of the magnetic brush against the image bearing member (e.g., photoreceptors) is relatively weak and high quality images can be produced. These carrier materials can be used alone or in combination.

The core material of the carrier preferably has a volume average particle diameter of from 10 to 150 μm, and more preferably from 20 to 80 μm. When the volume average particle diameter is smaller than 10 μm, a carrier scattering problem in that carrier particles scatter around the developing device tends to occur because the particles have weak magnetization per particle. In contrast, when the particle diameter is larger than 150 μm, the surface area of the carrier per unit weight decreases and thereby a toner scattering problem in that the toner scatters around the developing device tends to be caused. In addition, another problem in that uneven solid images are formed in full color image formation tends to occur.

Specific examples of the resins to be applied on the carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoro-copolymers such as tetrafluoroethylene-vinylidenefluoride-another monomer including no fluorine atom, silicone resins, epoxy resins, etc. These resins can be used alone or in combination.

Specific examples of the amino resins include urea-formaldehyde resins, melamine resins, benzoguanamine resins, urea resins, and polyamide resins.

Specific examples of the vinyl or vinylidene resins include acrylic resins, polymethyl methacrylate resins, polyacrylonitirile resins, polyvinyl acetate resins, polyvinyl alcohol resins, polyvinyl butyral resins, etc.

Specific examples of the polystyrene resins include polystyrene resins and styrene-acrylic copolymers.

Specific examples of the halogenated olefin resins include polyvinyl chloride resins.

Specific examples of the polyester resins include polyethylene terephthalate resins and polybutylene terephthalate resins.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The resin layer can be formed by coating a core material with a resin solution, which is prepared by dissolving a resin in a solvent, using any known coating method, followed by drying and baking. Suitable coating methods include dip coating methods, spray coating methods, brush coating methods, etc.

Specific examples of the solvent include toluene, xylene, methyl ethyl ketone, methyl isobutyl ketone, cellosolve butyl acetate, etc.

The baking method is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The coated amount of the resin is preferably 0.01 to 5.0% by weight based on the weight of the carrier. When the coated amount is less than 0.01% by weight, it is possible that a uniform resin layer cannot be formed. When the coated amount is greater than 5.0% by weight, the carrier particles tend to aggregate, and thereby a coated carrier having uniform quality cannot be prepared, resulting in uneven charging of the toner.

The weight ratio (T/C) of the toner (T) to the carrier (C) in the two component developer is from 10/90 to 2/98, and preferably from 7/93 to 3/97.

The developer of the present invention can be used for known dry developing methods such as magnetic one component developing methods, nonmagnetic one component developing methods, two component developing methods, etc.

Since the image forming method and apparatus of the present invention use the toner of the present invention, which has improved upper fixable temperature, improved lower fixable temperature, and improved high temperature preservability and which can produce images with good haze factor, the image forming method and apparatus can efficiently produce high quality images.

Next, the image forming method and apparatus of the present invention will be explained in detail.

The image forming method includes at least the following processes:

(1) A charging process in which an electrostatic latent image bearing member is charged;

(2) A light irradiating process in which the charged image bearing member is irradiated with light to form an electrostatic latent image on the image bearing member;

(3) A developing process in which the electrostatic latent image on the image bearing member is developed with a developer including the toner of the present invention (or the two component developer of the present invention) to form a toner image on the image bearing member;

(4) A transferring process in which the toner image on the image bearing member is transferred onto a receiving material; and (5) A fixing process in which the toner image on the receiving material is fixed thereto.

The image forming apparatus of the present invention includes at least the following devices:

(1) A latent image bearing member (e.g., photoreceptor);

(2) A charging device configured to charge the surface of the image bearing member;

(3) A light irradiating device configured to irradiate the charged image bearing member with light to form an electrostatic latent image on the image bearing member;

(4) A developing device configured to develop the electrostatic latent image with a developer including the toner of the present invention (or the two component developer of the present invention) to form a toner image on the image bearing member;

(5) A transferring device configured to transfer the toner image on the image bearing member onto a receiving material; and (6) A fixing device configured to fix the toner image on the receiving material.

The image forming apparatus optionally includes a cleaning device configured to clean the surface of the image bearing member after transferring the toner image.

The image forming apparatus of the present invention will be explained by reference to FIGS. 1-3.

FIG. 1 illustrates an example of the image forming apparatus of the present invention. The image forming apparatus is a tandem electrophotographic image forming apparatus using an indirect transfer method, but the image forming apparatus of the present invention is not limited thereto.

Referring to FIG. 1, the tandem-type color image forming apparatus includes an image forming section 100, a receiving material feeding section 200 on which the image forming section is located, a scanner (i.e., image reader) 300 located on the image forming section, and an automatic document feeder (i.e., ADF) 400 located on the scanner.

The image forming section 100 includes the endless intermediate transfer medium (belt) 10, which is provided in the center of the image forming section 100 and which extends in the horizontal direction. The intermediate transfer medium 10 is rotated clockwise by support rollers 14, 15 and 16, one of which is a driving roller and the others of which are driven rollers, while tightly stretched by the rollers. A belt cleaning device 17 is provided near the support roller 15 to remove particles of the toner remaining on the surface of the intermediate transfer medium 10 even after a toner image is transferred.

Four image forming units 18 (i.e., a tandem image forming section 20) for forming black, yellow, magenta, and cyan toner images are arranged side by side on a flat portion of the intermediate transfer medium 10 supported by the rollers 14 and 15. A light irradiating device 21 configured to irradiate the photoreceptors with light beams to form electrostatic latent images thereon is arranged over the tandem image forming section 20.

A second transfer device 22 is provided below the intermediate transfer medium 10. The second transfer device 22 includes an endless belt 24 which is rotatably supported by a pair of rollers 23 while stretched thereby. The second transfer device 22 is pressed to the support roller 16 with the intermediate transfer medium 10 therebetween to transfer the toner image on the intermediate transfer medium onto a receiving material sheet fed by the second transfer device 22.

A fixing device 25 is arranged at a location near the second transfer device 22. The fixing device 25 includes an endless fixing belt 26, and a pressure roller 27, which presses the fixing belt.

The second transfer device 22 also has a function of feeding the receiving material sheet bearing the toner image thereon to the fixing device 25.

In addition, a sheet reversing device 28 configured to reverse the receiving material sheet bearing the toner image thereon is provided at a location below the second transfer device 22 and the fixing device 25, to produce double-sided copies.

Then the full color image forming operation of the tandem-type color image forming apparatus will be explained.

An original to be copied is set on an original table 30 of the automatic document feeder 400. Alternatively, the original can be directly set on a glass plate 32 of the scanner 300 after the automatic document feeder 400 is opened, followed by closing the automatic document feeder 400. When a start button (not shown) is pushed, the color image of the original set on the glass plate 32 is scanned with a first traveler 33 and a second traveler 34, which move in the right direction in FIG. 3. In the case where the original is set on the original table 30 of the automatic document feeder 400, at first the original is fed to the glass plate 32, and then the color image thereon is scanned with the first and second travelers 33 and 34. The first traveler 33 irradiates the color image of the original with light and the second traveler 34 reflects the light reflected from the color image to send the color light image to a sensor 36 via a focusing lens 35. Thus, color image information (i.e., black, yellow, magenta and cyan color image data) is read.

In addition, when the start button (not shown) is pushed, the intermediate transfer medium 10 is rotated by the driving support roller 14, 15 or 16, which is rotated by a driving motor (not shown), and the driven support rollers (residual two rollers of the rollers 14, 15 and 16). At the same time, photoreceptors 40 of the image forming units 18 are rotated by a driving motor (not shown) so that black, yellow, magenta and cyan color toner images are formed on the photoreceptors 40.

The black, yellow, magenta and cyan color toner images thus formed on the photoreceptors 40 are transferred one by one by respective transferring devices 62 to the intermediate transfer medium 10, resulting in formation of a combined color toner image on the intermediate transfer medium 10.

On the other hand, when the start button is pushed, one of paper feeding rollers 42 is selectively rotated to feed one or more receiving materials sheets (hereinafter referred to as paper sheets) stacked on a paper cassette 44 in a paper bank 43 while the paper sheets are separated one by one by a separation roller 45 when plural paper sheets are continuously fed. A feed roller 47 feeds the paper sheet to a passage 48 in the image forming section 100 through a passage 46 in the paper feeding section 200, and the paper sheet is then stopped once by a pair of registration rollers 49.

The registration rollers 49 are timely rotated to feed the paper sheet so that the combined color toner image on the intermediate transfer medium 10 is transferred onto a proper position of the paper sheet at a secondary transfer position at which the intermediate transfer medium is contacted with the second transfer device 22. The paper sheet bearing the combined color toner image thereon is then fed to the fixing device 25 by the second transfer device 22. The combined color toner image is fixed on the paper by the fixing device 25, resulting in formation of a full color image.

The paper sheet bearing a fixed full color toner image thereon is discharged from the image forming section 100 by a discharge roller 56 while the path is properly selected by a paper path changing pick 55. Thus, a discharged copy is stacked on a tray 57. When a double sided copy is produced, the paper path changing pick 55 is switched to feed the paper sheet having a fixed toner image on one side thereof to the sheet reversing device 28 so that the paper sheet is reversed. The thus reversed paper sheet is then fed to the second transfer device 22 so that another image is transferred to the other side of the paper sheet. The second image formed on the other side is also fixed by the fixing device 25 and then the double-sided copy is discharged to the tray 57 by the discharge roller 56.

After the combined color toner image is transferred onto the paper sheet, toner particles remaining on the intermediate transfer medium 10 are removed by the belt cleaning device 17 so that the tandem image forming section 20 can form the following image thereon.

In the tandem image forming section 20, each of the image forming units 18 includes the photoreceptor 40, and a charging device 60 (illustrated in FIG. 2), a developing device 61 (illustrated in FIG. 2), the primary transfer device 62, a discharging device 64 (illustrated in FIG. 2), etc., which are arranged around the photoreceptor. A photoreceptor cleaning device 63 (illustrated in FIG. 2) including a cleaning blade is also provided around the photoreceptor to remove toner particles remaining on the photoreceptor even after the toner image is transferred onto the intermediate transfer medium 10.

Figure 2:
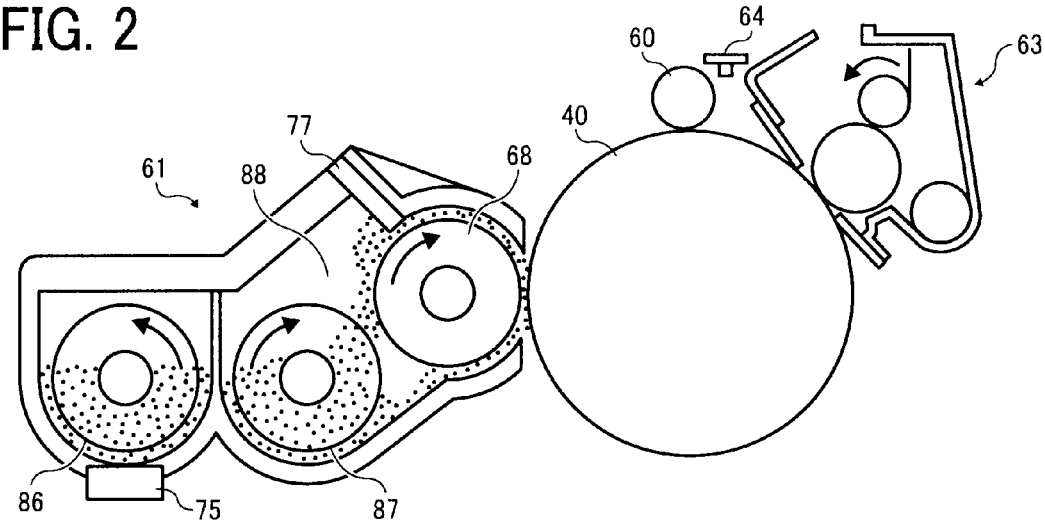
FIG. 2 is a schematic view illustrating the developing device of the image forming apparatus illustrated in FIG. 1.

As illustrated in FIG. 2, the developing device includes a first toner agitator 86 serving as a developer agitator/feeder configured to agitate and feed the replenished toner, a second toner agitator 87 configured to agitate the toner fed by the first toner agitator 86 and contained in a developing portion 88 of the developing device 61, a developing sleeve 68, a toner concentration sensor 75, a doctor blade 77, etc. An opening (point A illustrated in FIG. 3) is provided on a portion of the outer wall surrounding the first toner agitator 86 so that the toner is supplied to the first toner agitator from a toner replenishing device (not shown). The screw of the first toner agitator 86 agitates the mixture of the toner supplied from the toner replenishing device and the developer (such as two component developer including a carrier and the toner) in the developing device, and feeding the mixed developer to the second agitator 87. The screw of the second toner agitator 87 agitates the mixture of the developer fed from the first toner agitator 86 and the developer in the developing portion, and feeds the mixture to the developing roller (i.e., the sleeve 68).

Figure 3:
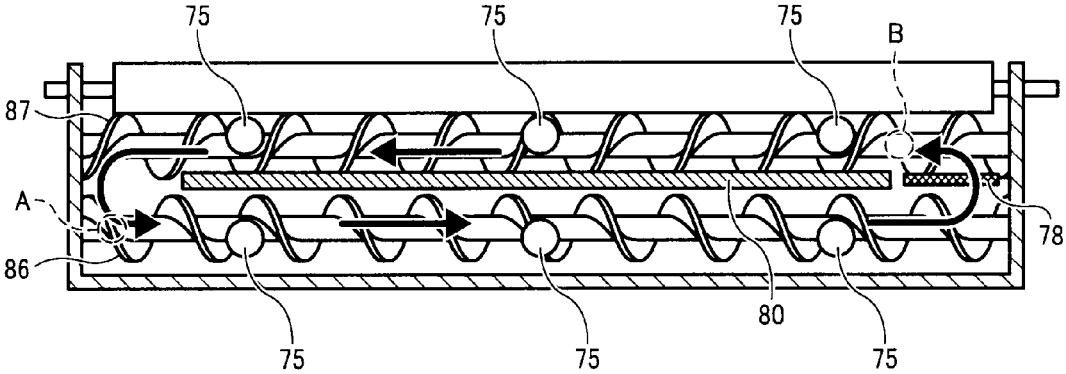
FIG. 3 is a plan view illustrating the developing device of the image forming apparatus illustrated in FIG. 2.

The first and second agitating rooms containing the respective agitators 86 and 87 are separated by a partition plate 80 as illustrated in FIG. 3. An opening is provided on both sides (i.e., points A and B) of the partition plate 80 to perform delivery and receipt of the developer. At the point A, the toner is supplied to the developing device (i.e., the first agitating room) by the toner replenishing device (not shown). Referring to FIG. 2, the developer in the second agitating room is drawn by the developing sleeve 68, and the developer is scraped by the doctor blade 77 so that a developer layer is formed on the developing sleeve 68 and the developer layer is fed to the developing region in which the developing sleeve is opposed to the photoreceptor 40 so that an electrostatic latent image on the photoreceptor is developed with the developer layer. In this case, the doctor blade 77 applies a largest rubbing force to the developer. In FIG. 3, numeral 78 denotes a developer path regulating member.

Figure 4:
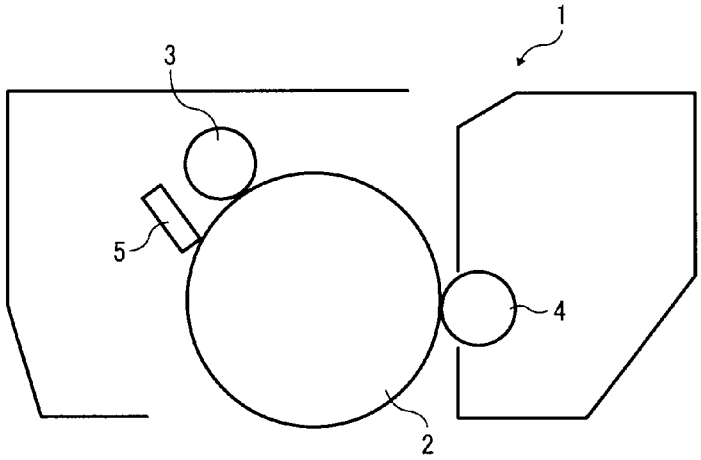
FIG. 4 is a schematic view illustrating a process cartridge for use in the image forming apparatus of the present invention.

FIG. 4 illustrates a process cartridge 1 for use in the image forming apparatus of the present invention. The process cartridge 1 includes a photoreceptor 2, a charging device 3 configured to charge the photoreceptor, a developing device 4 configured to develop an electrostatic image formed on the photoreceptor with a developer including the toner of the present invention, and a cleaning device 5 configured to clean the surface of the photoreceptor.

The configuration of the process cartridge is not limited thereto. The process cartridge includes at least a photoreceptor and a developing device configured to develop an electrostatic image formed on the photoreceptor with a developer including the toner of the present invention, and optionally includes other devices such as charging devices, and cleaning devices. The process cartridge is detachably attachable to an image forming apparatus such as copiers and printers as a unit.

In an image forming apparatus, to which the process cartridge mentioned above is attached, the photoreceptor 2 of the process cartridge is rotated at a predetermined speed. The rotated photoreceptor 2 is charged with a charging device so that the charged photoreceptor has a predetermined negative or positive potential. The charged photoreceptor 2 is irradiated with imagewise light (e.g., slit irradiation or laser beam scanning) emitted from a light irradiating device to form an electrostatic latent image thereon. The electrostatic latent image is developed with the developing device 4 to form a toner image on the photoreceptor 2.

Similarly to the image forming processes mentioned above, the toner image is then transferred onto a receiving material, which is fed from a receiving material feeding section, by a transferring device. The receiving material bearing the toner image thereon is separated from the photoreceptor 2, and the toner image is fixed on the receiving material by a fixing device, resulting in formation of a copy. The copy is discharged from the image forming apparatus. After the toner image is transferred, the surface of the photoreceptor is cleaned by a cleaning blade of a cleaning device. After the photoreceptor is discharged to reduce the charges remaining thereon, the next image forming operation is performed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, methods for measuring physical properties of the toner and the binder resin will be explained.

1. Volume Average Particle Diameter (Dv) and Ratio (Dv/Dn)

The particle diameter distribution of a toner (or mother toner particles) is measured with a measuring system including an instrument, MULTISIZER III from Beckman Coulter Inc., an interface (from Nikkaki Bios Co., Ltd.) outputting a number particle diameter distribution and a volume particle diameter distribution, and a personal computer. In addition, 1% by weight aqueous solution of a first class Nacl is used as an electrolyte.

The procedure is as follows.

(1) 0.1 to 5 ml of a surfactant (alkylbenzene sulfonic acid salt) serving as a dispersant is mixed with 100 to 150 ml of the electrolyte;

(2) 2 to 20 mg of a sample (toner) is added to the electrolyte;

(3) The mixture is subjected to a dispersing treatment for 1 to 3 minutes using an ultrasonic dispersing machine;

(4) The dispersion of the sample is dropped into 100 to 200 ml of the electrolyte contained in a beaker to prepare a dispersion having a predetermined concentration, which is used for measurement; and (5) The number particle diameter distribution and volume particle diameter distribution of the sample are determined from 5000 particles of the sample in the dispersion using the instrument MULTISIZER HI and an aperture with 100 μm, and the volume average particle diameter (Dv), the number average particle diameter (Dn) and the ratio (Dv/Dn) are determined from the particle diameter distributions.

2. Glass transition temperature (Tg) of resin

The glass transition temperature (Tg) of a resin is measured with a TG-DSC System TAS-100 from Rigaku Corporation. The method is as follows.

(1) About 10 mg of a sample, which is contained in an aluminum container, is set on a holder unit, and the holder unit is set in an electric furnace;

(2) The sample is heated from room temperature to 150° C. at a temperature rising speed of 10° C./min, followed by heating at 150° C. for 10 minutes and cooling to room temperature; and (3) After the sample is allowed to settle at room temperature for 10 minutes, the sample is heated again from room temperature to 150° C. at a temperature rising speed of 10° C./min in a nitrogen atmosphere to obtain a DSC curve of the sample.

The glass transition temperature (Tg) of the sample is determined using an analyzing system of TAS-100. The glass transition temperature is defined as the temperature at which the tangent line of the endothermic curve crosses the base line.

3. Weight average molecular weight (Mw), number average molecular weight (Mn) and peak top molecular weight (Mp)

The weight average molecular weight (Mw), number average molecular weight (Mn) and peak top molecular weight (Mp) of tetrahydrofuran(THF)-soluble components of a resin are measured using a gel permeation chromatography (GPC). The measuring conditions are as follows.

Instrument: HLC-8120 from Tosoh Corp.

Column: TSKgelGMHXL (2 pieces)

Measuring temperature: 40° C.

Sample: 0.25% by weight THF solution of THF-soluble components of a resin

Amount of injected sample: 100 ml

Detector: refraction index detector

Reference material: polystyrene

The peak top molecular weight is defined as the molecular weight at which a maximum peak is observed in the chromatogram.

Binder Resin Synthesis Example 1

Synthesis of Resin 1 (Low Molecular Weight Polyester)

The following components were fed into a reaction vessel equipped with a condenser, an agitator and a nitrogen feed pipe.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The mixture was subjected to a polymerization reaction for 8 hours at 230° C. under normal pressure, followed by a further polymerization reaction for 5 hours under a reduced pressure of from 10 to 15 mmHg (1.33 to 2.00 Pa). Next, 44 parts by weight of trimellitic anhydride was added to the reaction product, and the mixture was subjected to a polymerization reaction for 2 hours at 180° C. under normal pressure. Thus a resin 1 was prepared.

It was confirmed that the resin 1 has a glass transition temperature of 45° C., a weight average molecular weight of 5,800, a number average molecular weight of 2,600, and an acid value of 24 mgKOH/g.

Dispersing Resin Synthesis Examples 2-8

Synthesis of Dispersing Resins 2-1 to 2-7 (Resins Used for Dispersing Release Agent)

The components (i.e., L-lactide, D-lactide, ϵ-caprolactone and tin octylate) listed in Table 1 were fed into a four-necked flask and the mixture was heated for 20 minutes at 190° C. in a nitrogen atmosphere to be melted and mixed (i.e., to be reacted). The added amounts (parts by weight) of the components are described in Table 1. After the reaction, residual lactides and ϵ-caprolactone were removed from the reaction product at a reduced pressure. Thus, dispersing resins 2-1 to 2-7 were synthesized.

TABLE 1

| Resin | L-lactide (parts by weight) | D-lactide (parts by weight) | ϵ-caprolactone (parts by weight) | tin octylate (parts by weight) |
|---|---|---|---|---|
| Resin 2-1 | 80 | 20 | 10 | 1 |
| Resin 2-2 | 70 | 30 | 5 | 1 |
| Resin 2-3 | 75 | 25 | 5 | 1 |
| Resin 2-4 | 80 | 20 | 10 | 1 |
| Resin 2-5 | 85 | 15 | 15 | 1 |
| Resin 2-6 | 65 | 35 | 15 | 1 |
| Resin 2-7 | 95 | 5 | 5 | 1 |

Example 1

Preparation of Toner 1

(1) Preparation of Particulate Resin Dispersion

The following components were fed into a reaction vessel equipped with an agitator and a thermometer.

| | |
|---|---|
| Water | 680 parts |
| Sodium salt of sulfate of an ethylene oxide adduct of methacrylic acid (ELEMINOL RS-30 from Sanyo Chemical Industries Ltd.) | 13 parts |
| Styrene | 80 parts |
| Methacrylic acid | 80 parts |
| Butyl acrylate | 105 parts |
| Ammonium persulfate | 2 parts |

The mixture was agitated for 1 hour by the agitator at a revolution of 4,200 rpm. As a result, a white emulsion was prepared.

After the emulsion was heated to 75'C, the emulsion was reacted for 4 hours at the temperature.

Further, 30 parts of a 1% by weight aqueous solution of ammonium persulfate was added thereto, and the mixture was aged for 6 hours at 75° C. Thus, a dispersion 1 of a particulate resin (i.e., a copolymer of styrene/methacrylic acid/butyl acrylate/sodium salt of sulfate of ethylene oxide adduct of methacrylic acid) was prepared.

The volume average particle diameter of the particles in the particulate resin dispersion 1, which was measured by an instrument LA-920 from Horiba Ltd., was 50 nm. In addition, a part of the particulate resin dispersion 1 was dried to prepare a solid of the dispersion 1. It was confirmed that the resin has a glass transition temperature (Tg) of 52° C. and a weight average molecular weight (Mw) of 120,000.

Next, the following components were mixed.

| | |
|---|---|
| Water | 780 parts |
| Participate resin dispersion 1 | 140 parts |
| 48.5% by weight aqueous solution of dodecyl diphenyl ether disulfonic acid sodium salt (ELEMINOL MON-7 from Sanyo Chemical Industries Ltd.) | 80 parts |

Thus, a milk white liquid (i.e., a particulate resin dispersion) was prepared.

(2) Preparation of Aqueous Medium (i.e., Aqueous Phase Liquid)

The following components were mixed while agitated to prepare an aqueous medium (i.e., aqueous phase liquid).

| | |
|---|---|
| Ion-exchange water | 300 parts |
| Particulate resin dispersion | 300 parts |
| Dodecylbenzenesulfonic acid sodium salt | 0.2 parts |

(3) Preparation of Polyester Prepolymer

The following components were fed into a reaction vessel equipped with a condenser, an agitator and a nitrogen feed pipe.

| | |
|---|---|
| Ethylene oxide (2 mole) adduct of bisphenol A | 680 parts |
| Propylene oxide (2 mole) adduct of bisphenol A | 80 parts |
| Terephthalic acid | 282 parts |
| Trimellitic anhydride | 22 parts |
| Dibutyl tin oxide | 2 parts |

The mixture was subjected to a polymerization reaction for 7 hours at 230° C. under normal pressure, followed by a further polymerization reaction for 5 hours under a reduced pressure of from 10 to 15 mmHg (1.33 to 2.00 Pa). Thus an intermediate polyester resin was prepared.

It was confirmed that the intermediate polyester resin has a number average molecular weight (Mn) of 2,300, a weight average molecular weight (Mw) of 9,900, a peak molecular weight (Mp) of 3,100, a glass transition temperature of 55° C., an acid value of 0.4 mgKOH/g, and a hydroxyl value of 51 mgKOH/g.

The following components were fed into a reaction vessel equipped with a condenser, an agitator and a nitrogen feed pipe.

| | |
|---|---|
| The intermediate polyester resin | 395 parts |
| Isophorone diisocyanate | 91 parts |
| Ethyl acetate | 550 parts |

The mixture was subjected to a polymerization reaction for 6 hours at 100° C. Thus, a polyester prepolymer was prepared. It was confirmed that the polyester prepolymer includes free isocyanate in an amount of 1.47% by weight.

(4) Preparation of Master Batch

The following components were mixed using a HENSCHEL MIXER mixer (from Mitsui Mining Co., Ltd.).

| | |
|---|---|
| Water | 1000 parts |
| Carbon black (PRINTEX 35 from Degussa AG, having DBP oil absorption of 42 ml/100 g, and pH of 9.5) | 530 parts |

The mixture was kneaded for 30 minutes at 150° C. using a two roll mill. After the kneaded mixture was cooled by rolling, the mixture was pulverized using a pulverizer (from Hosokawa Micron Corp.). Thus, a master batch was prepared.

(5) Preparation of Ketimine Compound

In a reaction vessel equipped with an agitator and a thermometer, 30 parts of isophorone diamine and 70 parts of methyl ethyl ketone were reacted for 5 hours at 50° C. to prepare a ketimine compound. It was confirmed that the ketimine compound has an amine value of 423 mgKOH/g.

(6) Preparation of Mother Toner

The following components were mixed in a container to prepare a resin solution.

| | |
|---|---|
| Resin 1 prepared above | 200 parts |
| Polyester prepolymer | 30 parts |
| Ethyl acetate | 130 parts |

Further, the following components were mixed in a container.

| | |
|---|---|
| The resin solution prepared above | 360 parts |
| Carnauba wax (molecular weight of 1,700, acid value of 2.8 mgKOH/g, penetration of 1.6 mm (at 40° C.)) | 10 parts |
| Dispersing resin 2-1 prepared above | 10 parts |
| Master batch prepared above | 10 parts |

The mixture was subjected to a dispersing treatment using a bead mill (ULTRAVISCOMILL from AIMEX CO., Ltd.) under the following conditions.

Liquid feeding speed: 1 kg/hr

Peripheral speed of disk: 6 m/sec

Bead: zirconia bead with a diameter of 0.5 mm

Filling factor of bead: 80% by volume

Repeat number of dispersing operation: 3 times (3 passes)

Thus, a dispersion was prepared.

The dispersion was mixed with 2.5 parts of the ketimine compound to prepare a toner constituent mixture liquid (i.e., an oil phase liquid).

Next, 150 parts of the above-prepared aqueous phase liquid was fed into a container, and agitated using a HOMOMIXER mixer (from Tokushu Kika Kogyo Co., Ltd.) in which the rotor was rotated at a revolution of 12,000 rpm. One hundred (100) parts of the toner constituent mixture was added thereto, and the mixture was agitated for 10 minutes to prepare an emulsified slurry. Further, 100 parts of the emulsified slurry was fed into a flask equipped with an agitator and a thermometer. The emulsified slurry was agitated for 12 hours at 30° C. at an agitation speed (peripheral speed) of 20 m/min to remove the solvent (i.e., ethyl acetate). Thus, a dispersion slurry was prepared.

After 100 parts of the dispersion slurry was filtered under a reduced pressure to prepare a wet cake, the following processes (a) to (f) were performed.

(a) The wet cake was mixed with 100 parts of ion-exchange water and the mixture was agitated for 10 minutes using a TK HOMOMIXER mixer rotated at a revolution of 12,000 rpm, followed by filtering.

(b) The wet cake prepared above in the process (a) was mixed with 300 parts of ion-exchange water and the mixture was agitated for 10 minutes using a TK HOMOMIXER mixer rotated at a revolution of 12,000 rpm, followed by filtering. This washing operation was performed twice.

(c) The wet cake prepared above in the process (b) was mixed with 20 parts of a 10% aqueous solution of sodium hydroxide, and the mixture was agitated for 30 minutes using a TK HOMOMIXER mixer rotated at a revolution of 12,000 rpm, followed by filtering under a reduced pressure.

(d) The wet cake prepared above in the process (c) was mixed with 300 parts of ion-exchange water and the mixture was agitated for 10 minutes using a TK HOMOMIXER mixer rotated at a revolution of 12,000 rpm, followed by filtering. This washing operation was performed twice.

(e) The wet cake prepared above in the process (d) was mixed with 20 parts of a 10% aqueous solution of hydrochloric acid, and the mixture was agitated for 10 minutes using a TK HOMOMIXER mixer rotated at a revolution of 12,000 rpm, followed by filtering.

(f) The wet cake prepared above in the process (e) was mixed with 300 parts of ion-exchange water, and the mixture was agitated for 10 minutes using a TK HOMOMIXER mixer rotated at a revolution of 12,000 rpm, followed by filtering. This washing operation was performed twice.

Thus, a final wet cake was prepared.

The final wet cake was dried for 48 hours in a circulating dryer heated to 45° C., followed by sieving using a screen having openings of 75 μm. Thus a mother toner 1 was prepared.

(7) Preparation of Toner

The following components were mixed using a HENSCHEL MIXER mixer (from Mitsui Mining Co., Ltd.).

| | |
|---|---|
| Mother toner 1 | 100 parts |
| Hydrophobized silica (H2000 from Clariant Japan K.K.) | 1.0 part |

In the mixing operation, the mixer was rotated at a peripheral speed of 30 m/sec for 30 seconds, followed by pausing for 1 minute. This mixing cycle was repeated 5 times.

The mixture was then sieved with a screen having openings of 35 μm.

Thus, a toner of Example 1 was prepared.

Examples 2 to 6

The procedure for preparation of the toner in Example 1 was repeated except that the dispersing resin 2-1 was replaced with each of the dispersing resins 2-2 to 2-6.

Thus, toners of Examples 2 to 6 were prepared.

Example 7

The procedure for preparation of the toner in Example 1 was repeated except that the added amount of the dispersing resin 2-1 was changed from 10 parts to 2 parts.

Thus, a toner of Example 7 was prepared.

Comparative Example 1

The procedure for preparation of the toner in Example 1 was repeated except that the dispersing resin 2-1 was replaced with the dispersing resin 2-7.

Thus, a toner of Comparative Example 1 was prepared.

Comparative Example 2

The procedure for preparation of the toner in Example 1 was repeated except that the dispersing resin 2-1 was not added.

Thus, a toner of Comparative Example 2 was prepared.

The dispersing resin used for Examples 1-7 and Comparative Examples 1-2 and the added amount of the dispersing resin are shown in Table 2.

TABLE 2

| | Dispersing resin | | |
|---|---|---|---|
| Toner | Name of the resin | Optical purity (%) | Added amount (parts) |
| Example 1 | 2-1 | 60 | 10 |
| Example 2 | 2-2 | 40 | 10 |
| Example 3 | 2-3 | 50 | 10 |
| Example 4 | 2-4 | 60 | 10 |
| Example 5 | 2-5 | 70 | 10 |
| Example 6 | 2-6 | 30 | 10 |
| Example 7 | 2-1 | 60 | 2 |
| Comparative Example 1 | 2-7 | 90 | 10 |
| Comparative Example 2 | — | — | 0 |

Dispersing Resin Synthesis Examples 9 and 10

Synthesis of Dispersing Resins 3-1 and 3-2

The components (i.e., 1,3-propane diol, 1,4-butane diol, L-lactide and D-lactide) listed in Table 3 and used for forming the polyester diol (b11) were fed into an autoclave reaction vessel equipped with a thermometer, an agitator and a nitrogen feed pipe. The mixture was heated for 20 minutes at 120° C. and normal pressure in a nitrogen atmosphere to be melted and mixed (i.e., to be reacted). The added amounts (parts by weight) of the components are described in Table 3. Next, 2 parts of tin 2-ethylhexanoate was added thereto, and the mixture was further reacted for 3 hours at 190° C. After the reaction, residual lactides and diols were removed from the reaction product at a reduced pressure, followed by cooling to room temperature and pulverizing. Thus, polyester diols (b11-1 and b11-2) having a polyhydroxycarboxylic acid unit were synthesized.

On the other hand, the components (i.e., ethylene oxide (2 mole) adduct of bisphenol A and terephthalic acid) listed in Table 3 and used for forming the polyester diol (b12) were subjected to a dehydration condensation reaction to prepare polyester diols (b12-1 and b12-2).

The thus prepared polyester diol (b12-1 or b12-2) and the above-prepared polyester diol (b11-1 or b11-2) were dissolved in methyl ethyl ketone, and isophorone diisocyanate (IPDI) was added to the mixture. The mixture was subjected to a polymer chain growth reaction for 6 hours at 50° C., followed by removal of the solvent. Thus, dispersing resins 3-1 and 3-2 were prepared.

TABLE 3

| | Resin 3 | | | | | |
|---|---|---|---|---|---|---|
| | | | | | Polyester diol (b-12) | |
| | Polyester diol (b-11) | | | | EO | Tereph- |
| Resin | 1,3-propane diol | 1,4-butane diol | L-lactide | D-lactide | adduct of BA | thalic acid |
| 3-1 | 2 | 0 | 54 | 14 | 15 | 15 |
| 3-2 | 0 | 2 | 50 | 13 | 17.5 | 17.5 |

EO adduct of BA: Ethylene oxide (2 mole) adduct of bisphenol A

In Table 3, the units are parts by weight.

Examples 8 and 9

Preparation of Toners 8 and 9

The procedure for preparation of the toner in Example 1 was repeated except that the dispersing resin 2-1 was replaced with 10 parts by weight of each of the dispersing resins 3-1 and 3-2.

Thus, toners of Examples 8 and 9 were prepared.

Preparation of Carrier

The following components were mixed.

| | |
|---|---|
| Toluene | 100 parts |
| Silicone resin (Organo straight Silicone) | 100 parts |
| γ-(2-aminoethyl)aminopropyltrimethoxysilane | 5 parts |
| Carbon black | 10 parts |

The mixture was dispersed for 20 minutes using a MOMO-MIXER mixer to prepare a carrier coating liquid.

The carrier coating liquid was applied on 1000 parts of spherical magnetite, which serves as a core material and which has a volume average particle diameter of 50 μm, using a fluidized bed coating device. Thus, a coated carrier was prepared.

Preparation of Two Component Developer

Five (5) parts of each of the toners of Examples 1-7 and Comparative Examples 1-2 was mixed with 95 parts of the coated carrier to prepare two component developers of Examples 1-7 and Comparative Examples 1-2.

Evaluation of Developer

Each of the toners and developers was evaluated with respect to the following items.

(1) Image density (ID)

The developer was set in a tandem color image forming apparatus (IMAGIO NEO 450 manufactured by Ricoh Co., Ltd.), and a black solid image was produced under the following conditions.

Temperature of fixing roller: 160±2° C.

Receiving material: TYPE 6000 PAPER <70W> from Ricoh Co., Ltd.

Weight of solid toner image: 1.00±0.05 mg/cm$^2$

The image densities of randomly selected six points of the black solid image were measured with a spectro-densitometer 938 from X-Rite Inc., and the image densities were averaged to obtain the average image density.

The image density was evaluated as follows.

◎: The average image density is not lower than 2.00. (Excellent)

○: The average image density is not lower than 1.70 and lower than 2.00.

X: The average image density is lower than 1.70. (Bad)

(2) Image Density Stability (IDS)

The procedure mentioned above in item (1) was performed just after the toner was replenished to the developer in the developing device and at a time when the replenished toner was agitated with the developer for 600 seconds without performing developing, to evaluate the image density stability.

The image density stability was evaluated as follows.

◎: The ratio (ID1/ID2) of the image density (ID1) of an image formed just after the toner was replenished to the image density (ID2) of an image formed at the time when the replenished toner was agitated for 600 seconds not lower than 0.95. (Excellent)

○: The ratio (ID1/ID2) is not lower than 0.85 and lower than 0.95.

X: The ratio (ID1/ID2) is lower than 0.85. (Bad)

(3) Fixability 3-1 High Temperature Fixability (HTF)

The developer was set in a copier MF-200 from Ricoh Co., Ltd., which had been modified such that a roller made of TEFLON is used as the fixing roller, and black solid images were produced under the following conditions to determine whether or not the hot offset phenomenon is caused. In this regard, the maximum fixable temperature is defined as a maximum fixing temperature, below which the hot offset phenomenon is not caused.

Temperature of fixing roller: changed from 170° C. to 190° C.

Receiving material: TYPE 6200 PAPER from Ricoh Co., Ltd.

Weight of solid toner image: 0.85±0.1 mg/cm$^2$

The high temperature fixability was graded as follows.

◎: The maximum fixable temperature is not lower than 190° C. (Excellent)

○: The maximum fixable temperature is not lower than 180° C. and lower than 190° C.

Δ: The maximum fixable temperature is not lower than 170° C. and lower than 180° C.

X: The maximum fixable temperature is lower than 170° C. (Bad)

3-2 Low Temperature Fixability (LTF)

The developer was set in the above-mentioned modified copier MF-200, and black solid images were produced under the following conditions.

Temperature of fixing roller: changed from 135° C. to 155° C.

Receiving material: THICK COPY PAPER <135> from NBS Ricoh

Weight of solid image: 0.85±0.1 mg/cm$^2$

Each of the solid images was rubbed with a white cotton cloth 5 times. The image density of the solid image was measured with the spectro-densitometer before and after the rubbing test to determine the ratio (IDa/IDb) of the image density (IDa) after the rubbing test to the image density (IDb) before the rubbing test. In this regard, the minimum fixable temperature is defined as a minimum fixing temperature, above which the ratio is not less than 70%.

The low temperature fixability was graded as follows.

◎: The minimum fixable temperature is lower than 135° C. (Excellent)

○: The minimum fixable temperature is not lower than 135° C. and lower than 145° C.

Δ: The minimum fixable temperature is not lower than 145° C. and lower than 155° C.

X: The minimum fixable temperature is not lower than 155° C. (Bad)

(4) High Temperature Preservability (HTP)

The high temperature preservability of the toner was evaluated using the method for measuring penetration based on JIS K2235-1991, which is as follows.

(a) At first, 20 g of a toner is contained in a 50 ml glass container;

(b) The container is allowed to settle for 24 hours in a chamber heated to 50° C.;

(c) The toner in the container is cooled to 24° C.; and (d) The toner is subjected to a penetration test in which a needle is penetrated into the toner layer at a predetermined pressure and the length (L) of the portion of the needle penetrated into the toner layer is measured.

In this regard, the longer penetration length (L) a toner has, the better high temperature preservability the toner has. The high temperature preservability was graded as follows:

◎: The penetration length (L) is not shorter than 25 mm. (Excellent)

○: The penetration length (L) is shorter than 25 mm and not shorter than 15 mm.

Δ: The penetration length (L) is shorter than 15 mm and not shorter than 5 mm.

X: The penetration length (L) is shorter than 5 mm. (Bad)

(5) Charge Quantity Stability (CQS)

Six (6) grams of the toner was contained in a metal cylinder, and the toner was agitated by an agitator rotated at a speed of 640 rpm. The charge quantity (Q) of the toner was measured by a blow-off method after the agitation operation was performed for 60 seconds and after the agitation operation was performed for 600 seconds to determine the ratio (Q60/Q600).

The charge quantity stability was graded as follows:

◎: The ratio (Q60/Q600) is not less than 70%. (Excellent)

○: The ratio (Q60/Q600) is not less than 50% and less than 70%.

X: The ratio (Q60/Q600) is less than 50%. (Bad)

(6) Haze Factor (HF)

A solid image was formed on an overhead projection sheet TYPE PPC-DX fro Ricoh Co., Ltd. using the above-mentioned image forming apparatus in which the fixing temperature is set to 160° C. The haze factor of the image was measured with a direct reading haze meter (HGM-2DP from Suga Test Instruments Co., Ltd.). In this regard, the lower haze factor a toner has, the better transparency (i.e., color property) the toner has.

The haze factor was graded as follows:

◎: The haze factor is less than 20%. (Excellent)

○: The haze factor is not less than 20% and less than 30%.

X: The haze factor is not less than 30%. (Bad)

(7) Filming Resistance (FR)

The developer was set in a color image forming apparatus IPSIO COLOR 8100 from Ricoh Co., Ltd. and a running test in which 100,000 copies of an original image are produced was performed. After the running test, the surface of the photoreceptor was visually observed to determine whether a film of the toner is formed thereon.

The filming resistance was graded as follows:

◎: No toner film is formed. (Excellent)

○: A linear toner film is hardly observed.

Δ: A linear toner film is observed at a portion of the photoreceptor.

X: Linear toner films are observed on the entire surface of the photoreceptor. (Bad)

(8) Overall Evaluation

In each of the above-mentioned evaluations, the following points are allotted to calculate the total point of each toner.

◎: 3 points

○: 2 points

Δ: 1 point

X: 0 point

Overall evaluation was performed as followed.

◎: The toner has a total point of not less than 21 points, and has no bad (x) property.

○: The toner has a total point of not less than 16 points and less than 21 points, and has no bad (x) property.

Δ: The toner has a total point of not less than 8 points and less than 16 points, and has no bad (x) property.

X: The toner has one or more bad (x) properties.

The evaluation results are shown in Tables 4-6.

TABLE 4

| | Volume average particle diameter Dv (μm) | Number average particle diameter Dn (μm) | Dv/Dn |
|---|---|---|---|
| Example 1 | 5.3 | 4.5 | 1.18 |
| Example 2 | 5.6 | 4.7 | 1.19 |
| Example 3 | 5.8 | 4.9 | 1.18 |
| Example 4 | 5.9 | 4.8 | 1.23 |
| Example 5 | 5.4 | 4.5 | 1.20 |
| Example 6 | 5.3 | 4.5 | 1.18 |
| Example 7 | 5.8 | 4.8 | 1.21 |
| Example 8 | 5.8 | 4.9 | 1.18 |
| Example 9 | 5.4 | 4.5 | 1.20 |
| Comparative Example 1 | 5.8 | 4.9 | 1.18 |
| Comparative Example 2 | 5.4 | 4.4 | 1.23 |

TABLE 5

| | LTF | HTF | HTP | ID | IDS |
|---|---|---|---|---|---|
| Example 1 | ◎ | ○ | ◎ | ◎ | ◎ |
| Example 2 | ◎ | ○ | ◎ | ◎ | ◎ |
| Example 3 | ◎ | ○ | ◎ | ◎ | ◎ |
| Example 4 | ◎ | ○ | ◎ | ◎ | ◎ |
| Example 5 | ◎ | ○ | ◎ | ◎ | ◎ |
| Example 6 | ◎ | ○ | ◎ | ◎ | ◎ |
| Example 7 | ◎ | ◎ | ◎ | ◎ | ◎ |
| Example 8 | ◎ | ◎ | ◎ | ◎ | ◎ |
| Example 9 | ◎ | ◎ | ◎ | ◎ | ◎ |
| Comparative Example 1 | ◎ | ◎ | ◎ | ◎ | X |
| Comparative Example 2 | ◎ | ◎ | ◎ | ◎ | X |

LTF: Low temperature fixability
HTF: High temperature fixability
HTP: High temperature preservability
ID: Image density
IDS: Image density stability

TABLE 6

| | Charge quantity stability | Haze factor | Film resistance | Overall evaluation |
|---|---|---|---|---|
| Example 1 | ◎ | ◎ | ◎ | ◎ |
| Example 2 | ◎ | ◎ | ◎ | ◎ |
| Example 3 | ◎ | ◎ | ◎ | ◎ |
| Example 4 | ◎ | ◎ | ◎ | ◎ |
| Example 5 | ◎ | ◎ | ◎ | ◎ |
| Example 6 | ◎ | ◎ | ◎ | ◎ |
| Example 7 | ◎ | ◎ | ○ | ◎ |
| Example 8 | ◎ | ◎ | ◎ | ◎ |
| Example 9 | ◎ | ◎ | ◎ | ◎ |
| Comparative Example 1 | X | X | X | X |
| Comparative Example 2 | X | ◎ | X | X |

It is clear from Tables 1-6 that when a dispersing resin including a polyhydroxycarboxylic acid unit, which is obtained from an optically active monomer and which has an optical purity (X) (i.e., |X(L)−X(D)|) of not greater than 80%, is used, the resultant toner has a good combination of low temperature fixability, high temperature fixability, high temperature preservability, and charge stability, and produces images having high image density and low haze factor with hardly causing the filming problem.

When a dispersing resin having a high optical purity is used like the toner of Comparative Example 1, the release agent cannot be well dispersed in the toner. Therefore, the toner has poor charge stability and poor filming resistance, and cannot produce images having high image density and low haze factor.

When a dispersing resin having a proper optical purity is not used like the toner of Comparative Example 2, the release agent cannot be well dispersed in the toner. Therefore, the toner has poor charge stability and poor filming resistance, and cannot produce images having high image density.

This document claims priority and contains subject matter related to Japanese Patent Application No. 2008-273328, filed on Oct. 23, 2008, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin;

a release agent;

a colorant; and a dispersing resin to disperse the release agent, wherein the dispersing resin includes a polyhydroxycarboxylic acid unit obtained from an optically active monomer, and wherein the polyhydroxycarboxylic acid unit has an optical purity X of not greater than 80%, wherein the optical purity X is defined by the following equation:

$$X(\%)=|X(L)-X(D)|,$$

wherein X(L) represents a mole percentage of a L-monomer in the optically active monomer, and X(D) represents a mole percentage of a D-monomer in the optically active monomer.

2. The toner according to claim 1, wherein the polyhydroxycarboxylic acid unit includes a unit obtained from an aliphatic hydroxycarboxylic acid having 3 to 6 carbon atoms.

3. The toner according to claim 1, wherein the polyhydroxycarboxylic acid unit includes a unit obtained from lactic acid.

4. The toner according to claim 1, wherein the polyhydroxycarboxylic acid unit includes a unit obtained from lactide.

5. The toner according to claim 1, wherein the polyhydroxycarboxylic acid unit includes a unit obtained from L-lactide and D-lactide.

6. The toner according to claim 1, wherein the dispersing resin includes a linear polyester resin obtained by reacting a polyester diol having a polyhydroxycarboxylic acid unit with another polyester diol using a polymer chain growing agent.

7. The toner according to claim 1, wherein a weight ratio (D/R) of the dispersing resin (D) to the release agent (R) is from 100/100 to 10/100.

8. The toner according to claim 1, wherein the binder resin includes a polyester resin.

9. The toner according to claim 1, wherein the binder resin includes a reaction product of a compound having an active hydrogen-containing group with a polyester resin having a functional group capable of reacting with the active hydrogen-containing group.

10. The toner according to claim 9, wherein the functional group capable of reacting with the active hydrogen-containing group is an isocyanate group.

11. The toner according to claim 1, wherein the binder resin has a glass transition temperature of from 40° C. to 70° C.

12. The toner according to claim 1, wherein the toner has a volume average particle diameter (Dv) of from 3 μm to 8 μm, and a ratio (Dv/Dn) of the volume average particle diameter (Dv) to a number average particle diameter (Dn) of the toner is from 1.00 to 1.25.

13. The toner according to claim 1, wherein the toner is prepared by a method including:

dissolving or dispersing at least the binder resin, the colorant, the release agent and the dispersing resin in an organic solvent to prepare a toner constituent mixture liquid;

emulsifying or dispersing the toner constituent mixture liquid in an aqueous medium; and then removing the organic solvent from the emulsion or dispersion to prepare particles of the toner.

14. A developer for developing an electrostatic image, comprising:

the toner according to claim 1; and a carrier.

15. An image forming method comprising:

charging an image bearing member;

irradiating the charged image bearing member with light to form an electrostatic latent image on the image bearing member;

developing the electrostatic latent image with a developer including the toner according to claim 1 to form a toner image on the image bearing member;

transferring the toner image onto a receiving material; and fixing the toner image on the receiving material.

* * * * *